US009260914B2

(12) United States Patent
Certain et al.

(10) Patent No.: US 9,260,914 B2
(45) **Date of Patent: *Feb. 16, 2016**

(54) COVERING FOR AN ARCHITECTURAL OPENING

(71) Applicant: Hunter Douglas Inc., Pearl River, NY (US)

(72) Inventors: William S. Certain, Westminster, CO (US); Kenneth M. Faller, Thornton, CO (US); Galen B. Rhodes, Henderson, CO (US); Max W. Schroeder, Westminster, CO (US); Kent A. Smith, Broomfield, CO (US); Stephen P. Smith, Denver, CO (US); Stephen M. Winters, Erie, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/211,766

(22) Filed: Mar. 14, 2014

(65) Prior Publication Data

US 2014/0262066 A1 Sep. 18, 2014

Related U.S. Application Data

(60) Provisional application No. 61/801,946, filed on Mar. 15, 2013.

(51) Int. Cl.

| | |
|---|---|
| ***E06B 9/34*** | (2006.01) |
| ***E06B 9/44*** | (2006.01) |
| ***E06B 9/26*** | (2006.01) |
| ***E06B 9/38*** | (2006.01) |
| *E06B 9/24* | (2006.01) |

(52) U.S. Cl.

CPC ... *E06B 9/44* (2013.01); *E06B 9/26* (2013.01); *E06B 9/34* (2013.01); *E06B 9/38* (2013.01); *E06B 2009/2435* (2013.01)

(58) Field of Classification Search

CPC ..... E06B 9/34; E06B 2009/2435; E06B 2009/3452; E06B 9/38

USPC ..... 160/84.01, 84.04, 84.05, 176.1 R, 121.1

See application file for complete search history.

(56) References Cited

U.S. PATENT DOCUMENTS 2,029,675 A * 2/1936 Schlamp ..... 160/121.1
2,723,715 A * 11/1955 Kauffmann et al. ..... 160/133

(Continued)

FOREIGN PATENT DOCUMENTS

KR 10-0815924 B1 3/2008
KR 10-0875633 B1 12/2008

(Continued)

*Primary Examiner* — Blair M Johnson

(74) *Attorney, Agent, or Firm* — Dorsey & Whitney LLP

(57) ABSTRACT

A covering for an architectural opening is provided. The covering may include an accumulator roller, a shade attached to the accumulator roller, and a shade actuation system. The shade may be wrappable about the roller. The shade may include two laterally-separable sheets interconnected by a plurality of vertically-spaced vanes. The shade actuation system may be selectively engageable with a confronting face of one of the two laterally-separable sheets. Engagement of the shade actuation system and the one of the two laterally-separable sheets may restrict movement of the one of the two laterally-separable sheets relative to the other of the two laterally-separable sheets.

22 Claims, 17 Drawing Sheets

(56) References Cited

U.S. PATENT DOCUMENTS

| | | | | |
|---|---|---|---|---|
| 2,853,130 | A * | 9/1958 | Bechtler | 160/133 |
| 2,914,122 | A * | 11/1959 | Pinto | 160/89 |
| 5,855,235 | A * | 1/1999 | Colson et al. | 160/121.1 |
| 6,289,964 | B1 | 9/2001 | Colson et al. | |
| 7,311,131 | B2 | 12/2007 | Nien et al. | |
| 8,191,605 | B2 * | 6/2012 | Kwak | 160/319 |
| 2009/0236053 | A1 | 9/2009 | Kimener | |
| 2011/0031343 | A1 | 2/2011 | Anderson et al. | |
| 2012/0222828 | A1 | 9/2012 | Kwak | |
| 2012/0291965 | A1 | 11/2012 | Marocco | |
| 2014/0138037 | A1 | 5/2014 | Colson et al. | |
| 2014/0216666 | A1 | 8/2014 | Smith et al. | |
| 2014/0262065 | A1 | 9/2014 | Faller | |
| 2014/0262068 | A1 * | 9/2014 | Buccola et al. | 160/120 |
| 2015/0047792 | A1 * | 2/2015 | Lukosiunas et al. | 160/84.05 |
| 2015/0059991 | A1 * | 3/2015 | Kwak | 160/113 |

FOREIGN PATENT DOCUMENTS

| | | | |
|---|---|---|---|
| KR | 10-0943408 | B1 | 2/2010 |
| KR | 10-2011-0139082 | A | 12/2011 |
| KR | 20130117067 | A | 10/2013 |
| WO | 2010/120077 | A2 | 10/2010 |
| WO | 2011/078583 | A2 | 6/2011 |
| WO | WO-2014/115684 | A1 * | 7/2014 |

* cited by examiner

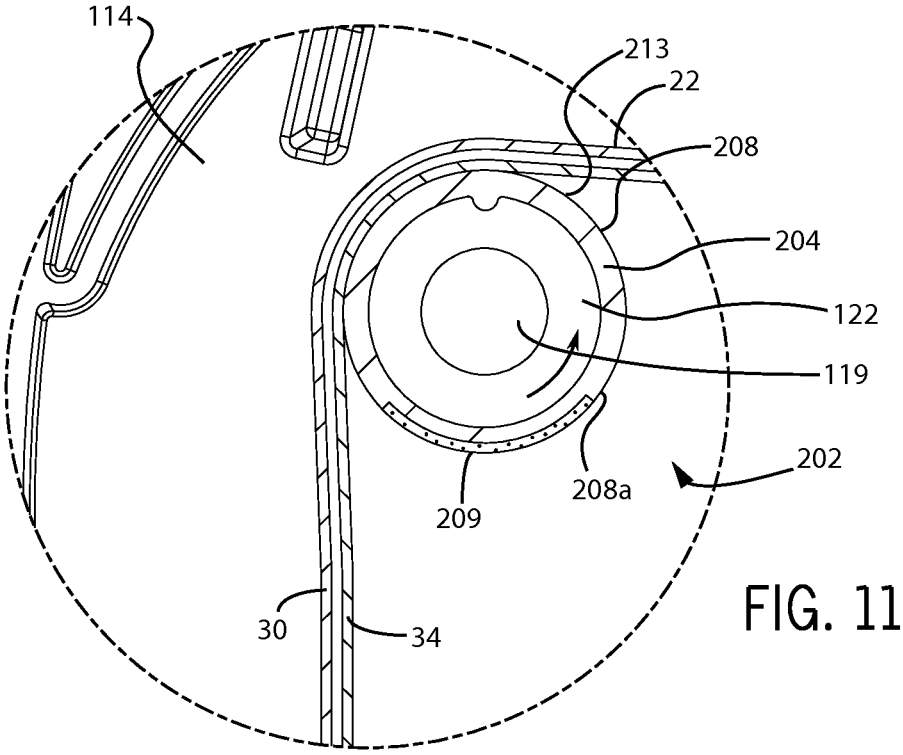
FIG. 11
FIG. 12
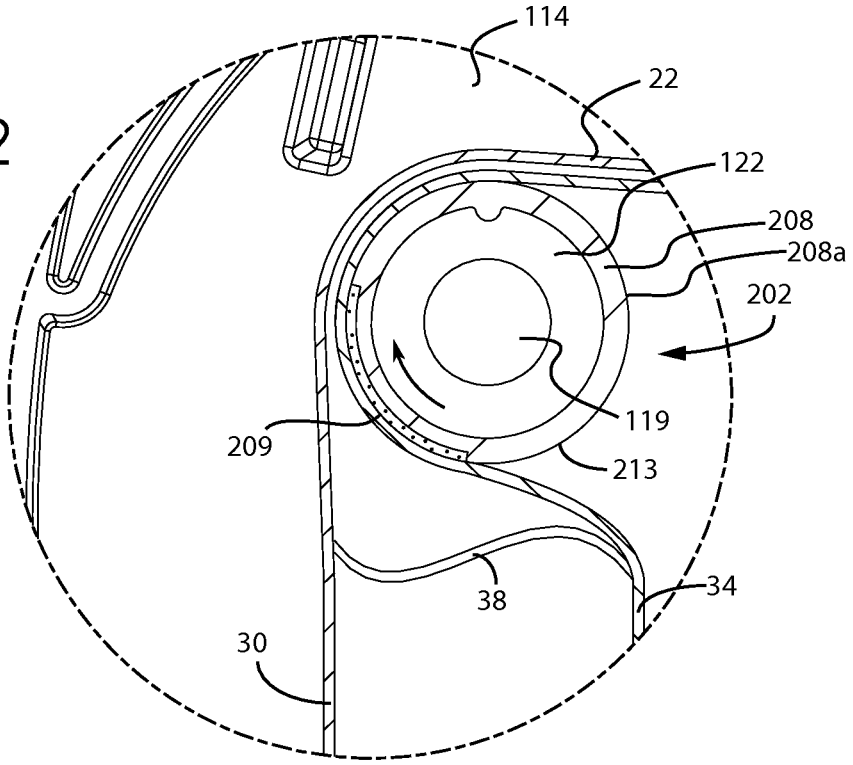

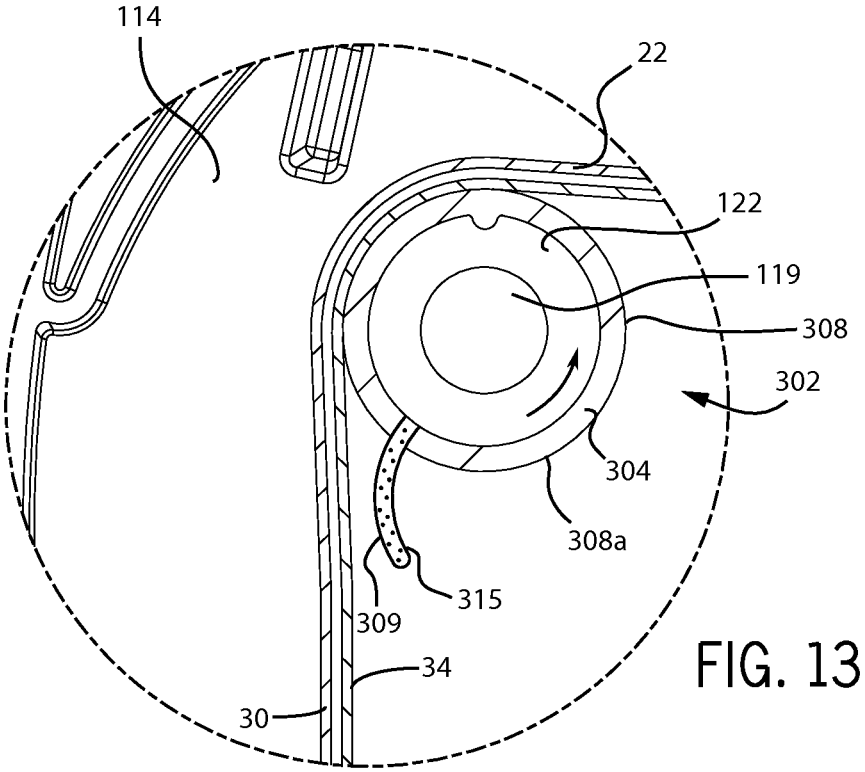
FIG. 13
FIG. 14
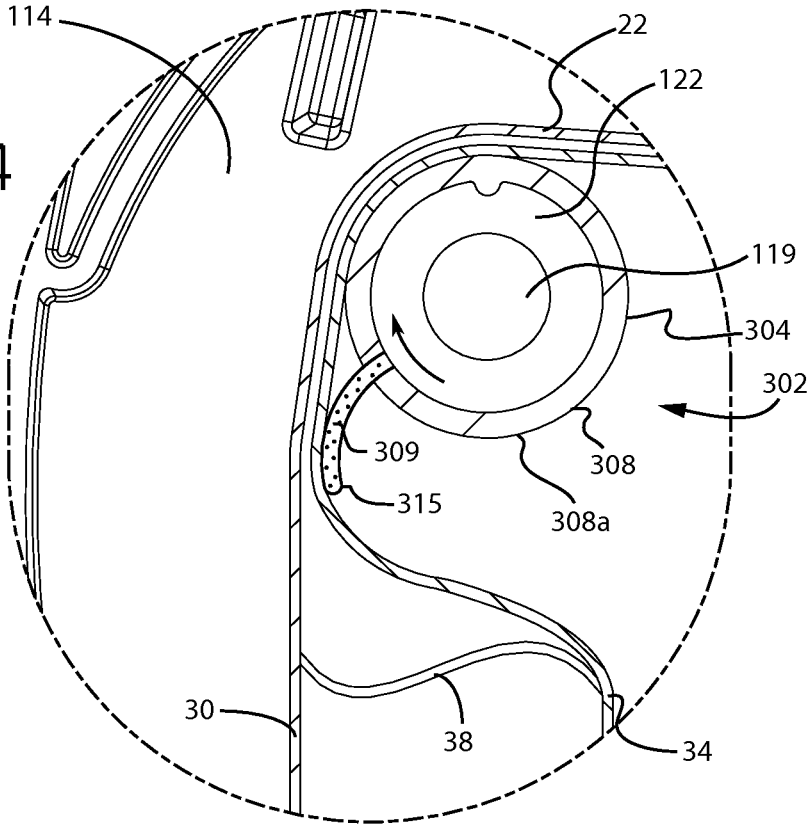

COVERING FOR AN ARCHITECTURAL OPENING

CROSS-REFERENCE TO RELATED APPLICATION

This application claims the benefit under 35 U.S.C. 119(e) of U.S. Provisional Application No. 61/801,946, filed Mar. 15, 2013, which is hereby incorporated by reference herein in its entirety.

FIELD

The present disclosure relates generally to coverings for architectural openings.

BACKGROUND

Coverings for architectural openings, such as windows, doors, archways, and the like, have taken numerous forms for many years. Some coverings include a retractable shade that is movable between an extended position and a retracted position. In the extended position, the shade of the covering may be positioned across the opening. In the retracted position, the shade of the covering may be positioned adjacent one or more sides of the opening.

SUMMARY

Examples of the disclosure may include a covering for an architectural opening. The covering may include a rotatable roller, a shade attached to the first roller and wrappable about the roller, and an actuator operably associated with the shade. The shade may include two laterally-separable sheets interconnected by a plurality of vertically-spaced vanes.

In another example, the covering may include an accumulator roller, a shade attached to the accumulator roller, and a shade actuation system. The shade may be wrappable about the accumulator roller. The shade may include two laterally-separable sheets interconnected by a plurality of vertically-spaced vanes. The shade actuation system may be selectively engageable with a confronting face of one of the two laterally-separable sheets. Engagement of the shade actuation system and the one of the two laterally-separable sheets may restrict movement of the one of the two laterally-separable sheets relative to the other of the two laterally-separable sheets. The shade actuation system may be engageable with the one of the two laterally-separable sheets at a partially extended position of the shade.

In some examples, the shade actuator system may include an actuator roller, and the shade may drape over the actuation roller. The actuation roller may be rotatable. The actuation roller may include an outer surface with a grip surface. The grip surface may extend around an entire periphery of the actuation roller. The grip surface may extend partially around a periphery of the actuation roller. The actuation roller may include an outwardly-projecting fin.

In some examples, the shade actuator system includes a cam plate rotatably coupled to the accumulator roller. In some examples, the shade actuator system includes a lever engaged with the cam plate. In some examples, the shade actuator system includes an engagement member non-rotatably coupled to the actuation roller. In some examples, the lever is selectively engageable with the engagement member based on the rotational position of the cam plate. In some examples, the lever includes a first leg that engages the cam plate and a second leg that selectively engages the engagement member.

In some examples, the lever is pivotable about an axis defined between the first and second legs.

In some examples, the shade actuator system may include a locking bar. The actuation roller may include an external gear, and the locking bar may include a lever with a gear profile corresponding to the external gear. The shade may extend between the actuation roller and the locking bar.

In some examples, the shade actuator system may include a plate and a positioning device pivotably coupled to the plate. The plate may be slidable relative to the positioning device. The positioning device may define a pathway, and the plate may include a pin that extends into the pathway. The pathway may form a closed loop. The pathway may define an island. The pathway may be recessed into a face of the positioning device that confronts the plate.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary. Moreover, reference made herein to "the present invention" or aspects thereof should be understood to mean certain examples of the present disclosure and should not necessarily be construed as limiting all examples to a particular description.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 11 is an enlarged view of the covering of FIG. 1 taken along the line 8-8 illustrated in FIG. 7 with another example shade actuator system.

FIG. 12 is an enlarged view of the covering of FIG. 1 taken along the line 10-10 illustrated in FIG. 9 with the shade actuator system of FIG. 11.

FIG. 13 is an enlarged view of the covering of FIG. 1 taken along the line 8-8 illustrated in FIG. 7 with another example shade actuator system.

FIG. 14 is an enlarged view of the covering of FIG. 1 taken along the line 10-10 illustrated in FIG. 9 with the shade actuator system of FIG. 13.

FIG. 21 depicts the shade actuator system in a raising or raised position with the shade in a closed configuration.

FIG. 22 depicts the shade actuator system in a first lowering position where the vanes begin to open.

FIG. 21 depicts the shade actuator system in a second lowering position where the vanes are continuing to open.

FIG. 24 depicts the shade actuator system in a third lowering position where the vanes are fully opened.

FIG. 25 depicts the shade actuator system in a fourth lowering position where the vanes are closed.

Figure 1:
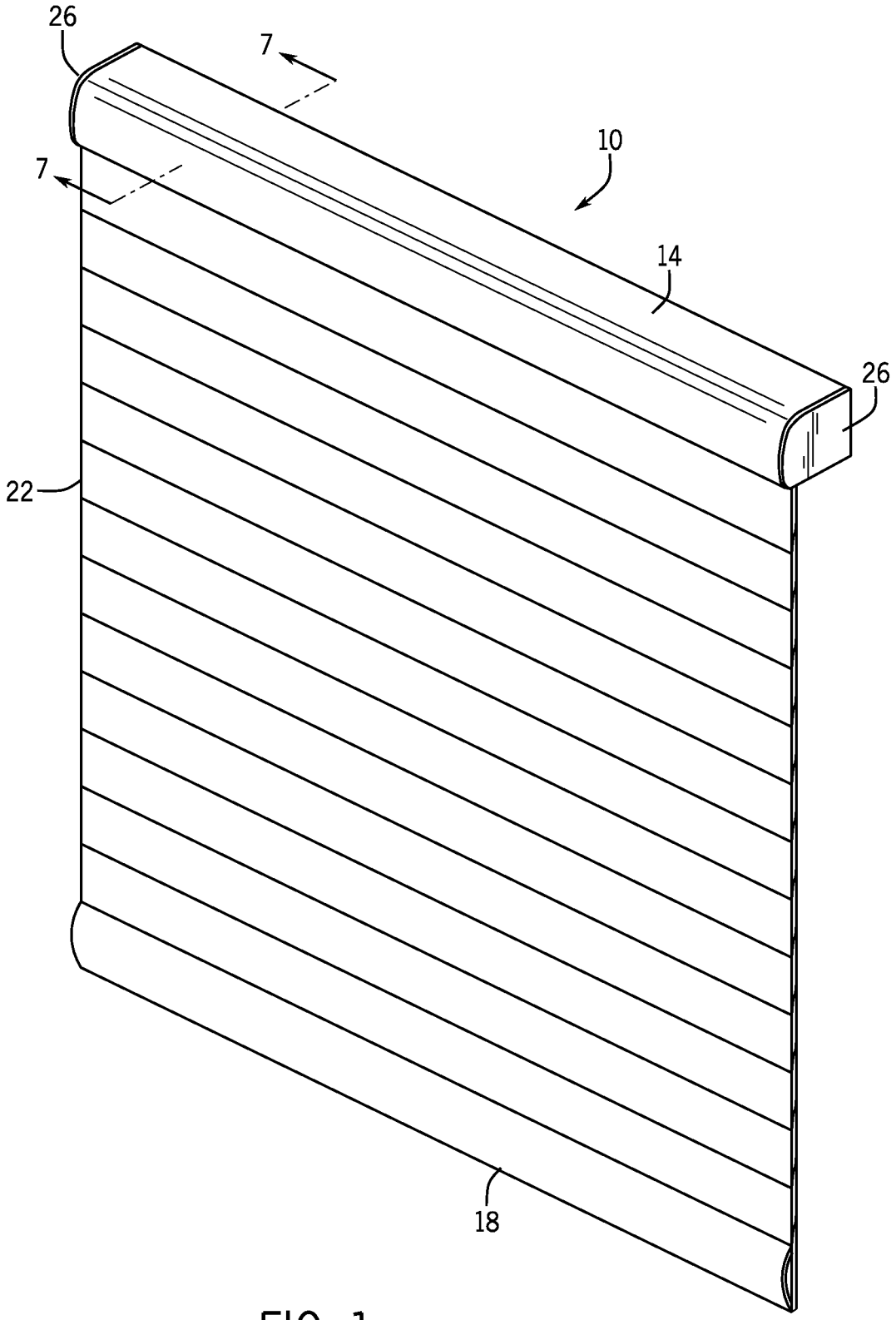
FIG. 1 is an isometric view of a covering with a shade extended from a front portion of a head rail and oriented in a closed or collapsed position.

It should be understood that the drawings are not necessarily to scale. In certain instances, details that are not necessary for an understanding of the disclosure or that render other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. It should be understood that the claimed subject matter is not necessarily limited to the particular examples or arrangements illustrated herein.

DETAILED DESCRIPTION

The present disclosure provides a covering for an architectural opening. The covering may include a head rail, a roller operably associated with the head rail, a shade attached to the roller, and a shade or vane actuator system operably associated with the shade to selectively open or expand the shade at substantially any extension position of the shade.

In one application of the shade or vane actuator system, a shade may include a pair of laterally-spaced sheets or panels of fabric interconnected to one another by a plurality of vertically-spaced vanes. The shade actuator system may selectively engage the shade to alter the relative motion between the sheets. In one implementation, the shade actuator system may selectively engage one of a front or a rear sheet of a shade to restrain movement of the respective sheet relative to the other sheet, thereby causing relative movement between the sheets, which may result in actuation of the shade from a closed or collapsed configuration into an open or expanded configuration.

The shade actuator system may include a grip surface that abuts, contacts, or engages a confronting face of a shade panel to restrict motion of that panel, while substantially not impairing the motion of another, non-contacted panel. The grip surface may be gnarled, knurled, adhesively treated, chemically etched, or include other friction surface features configured to resist movement of a shade member along or over the grip surface. The grip surface may be movable relative to the shade to selectively engage the shade. For example, the grip surface may be pivotable, rotatable, translatable, or otherwise movable into engagement with the shade. The grip surface may be releasably locked into an engaged or disengaged position.

The shade actuator system may include a slide surface that abuts or contacts a confronting face of a shade panel. The slide surface may be configured to permit the shade panel to move substantially freely or uninhibited along or over the slide surface. The slide surface may include a surface finish, such as a polish, to facilitate substantially free movement of the confronting shade member along or over the slide surface. The slide surface may be movable relative to the shade to selectively contact the shade. For example, the slide surface may be pivotable, rotatable, translatable, or otherwise movable into contact with the shade. The slide surface may be releasably locked into an engaged or disengaged position. In some implementations, the slide surface may be in an opposite position relative to the grip surface. For example, when the grip surface is in an engaged position, the slide surface may be in a disengaged position, and vice versa.

Figure 2:
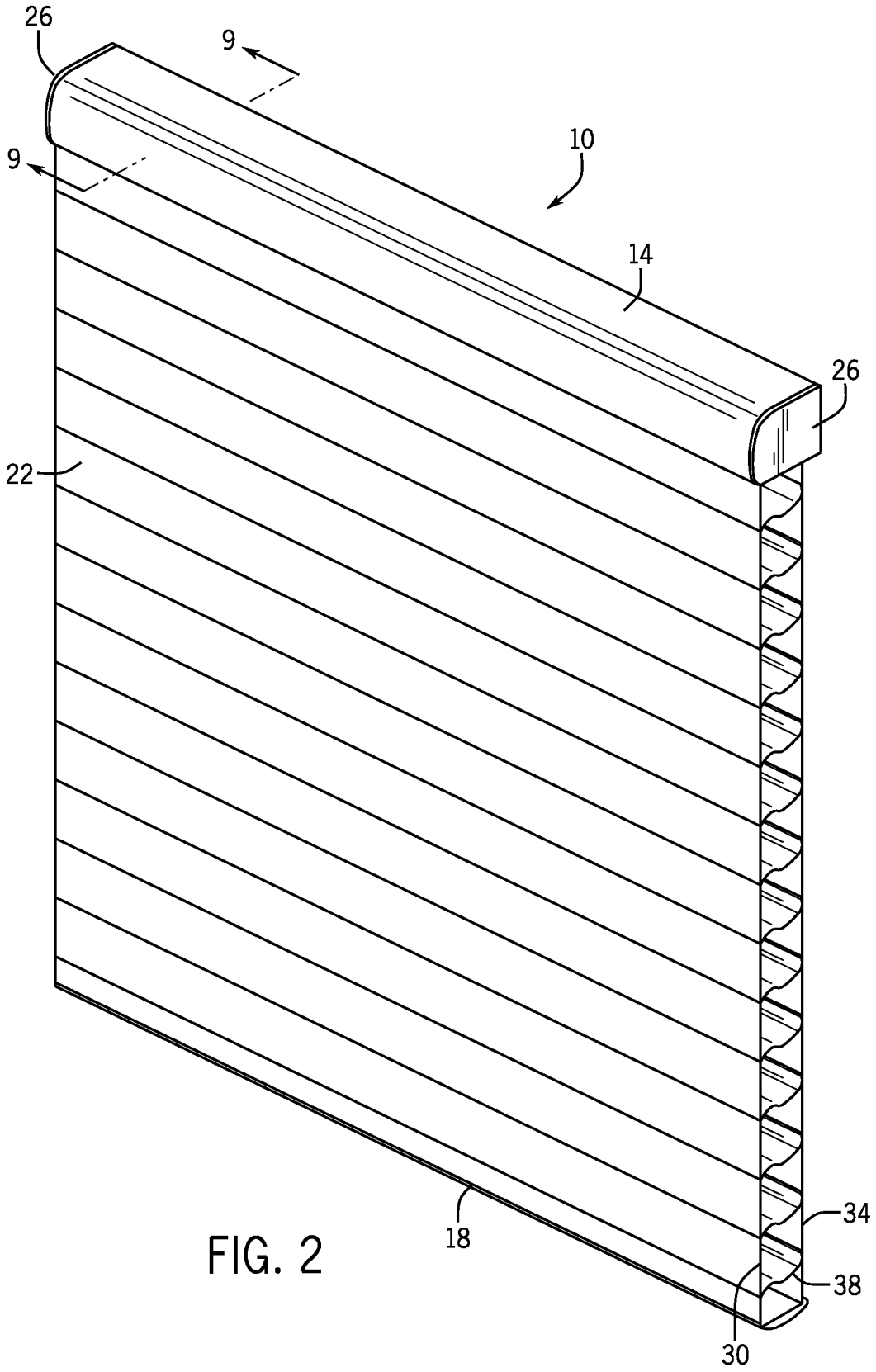
FIG. 2 is an isometric view of the covering of FIG. 1 with the shade in an open or expanded position.

Referring to FIGS. 1-2, a retractable covering 10 for an architectural opening is provided. The retractable covering 10 may include a head rail 14, a bottom rail 18, and a shade 22 extending between the head rail 14 and the bottom rail 18. The head rail 14 may include two opposing end caps 26, which may enclose the ends of the head rail 14 to provide a finished appearance. The bottom rail 18 may extend substantially horizontally along a lower edge of the shade 22 and may function as a balast to maintain the shade 22 in a taut condition.

The shade 22 may include vertically suspended front and rear panels or sheets 30, 34 of flexible material (such as sheer fabric) and a plurality of horizontally-extending, vertically-spaced flexible, semi-rigid, or rigid vanes 38. Each of the vanes 38 may be secured along horizontal lines of attachment with a front edge attached to the front sheet 30 and a rear edge attached to the rear sheet 34. The sheets 30, 34 and vanes 38 may form a plurality of elongated, vertically-aligned, longitudinally-extending, transversely-collapsible cellular units which are longitudinally secured, such as adhered, to adjacent cellular units to define a vertical stack of cellular units, which may be referred to as a cellular panel. The sheets 30, 34 and/or the vanes 38 may be constructed of continuous lengths of material or may be constructed of strips of material attached or joined together in an edge-to-edge, overlapping, or other suitable relationship.

The shade 22 may be constructed of substantially any type of material. For example, the shade 22 may be constructed from natural and/or synthetic materials, including fabrics, polymers, and/or other suitable materials. Fabric materials may include woven, non-woven, knits, or other suitable fabric types. The shade 22 may have any suitable level of light transmissivity. For example, the shade 22, including the sheets 30, 34 and/or the vanes 38, may be constructed of transparent, translucent, and/or opaque materials to provide a desired ambience or décor in an associated room. In one example, the sheets 30, 34 are transparent and/or translucent, and the vanes 38 are translucent and/or opaque.

Figure 3:
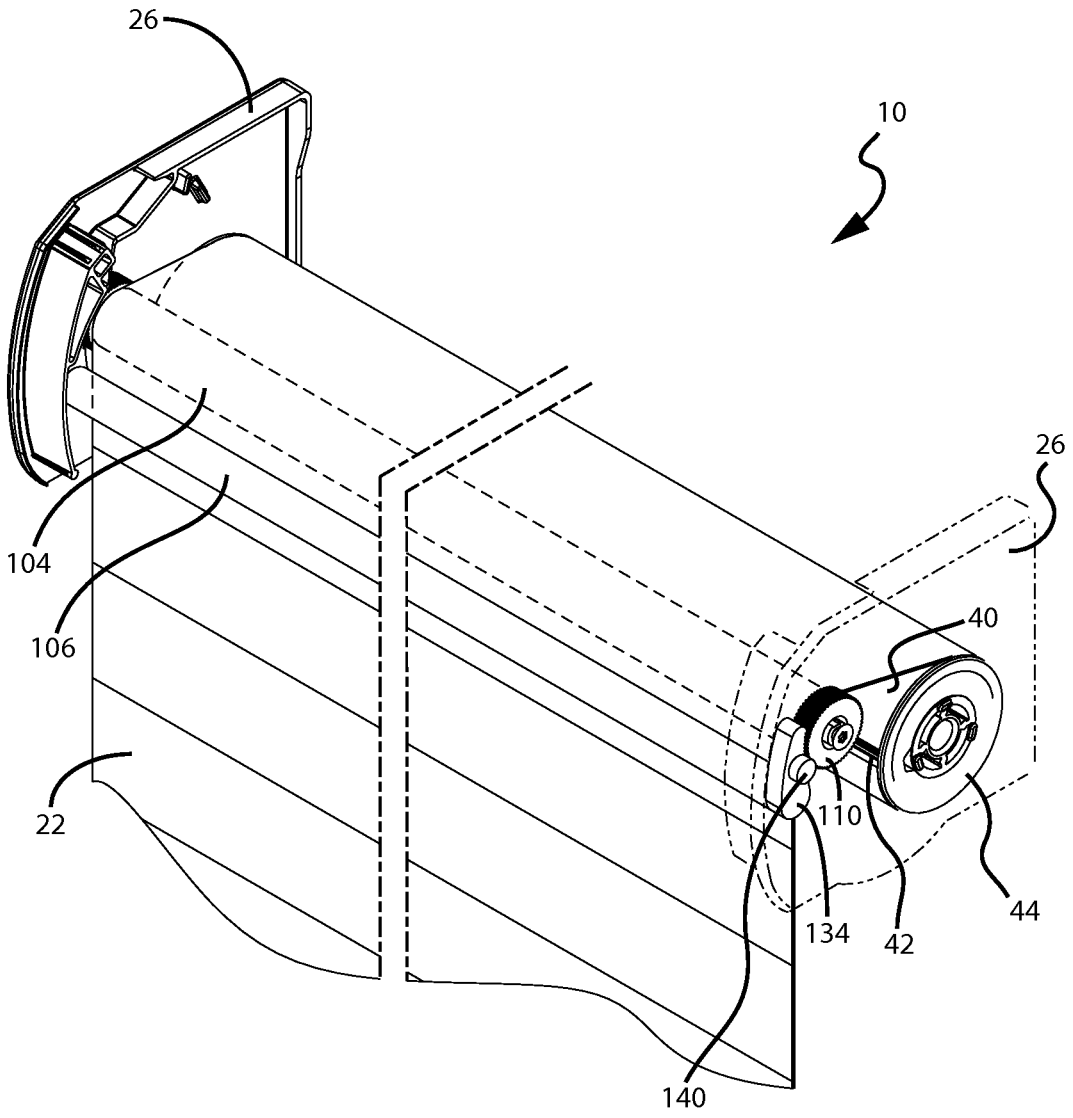
FIG. 3 is a fragmentary, isometric view of the covering of FIG. 1 with an example shade actuator system.
Figure 4:
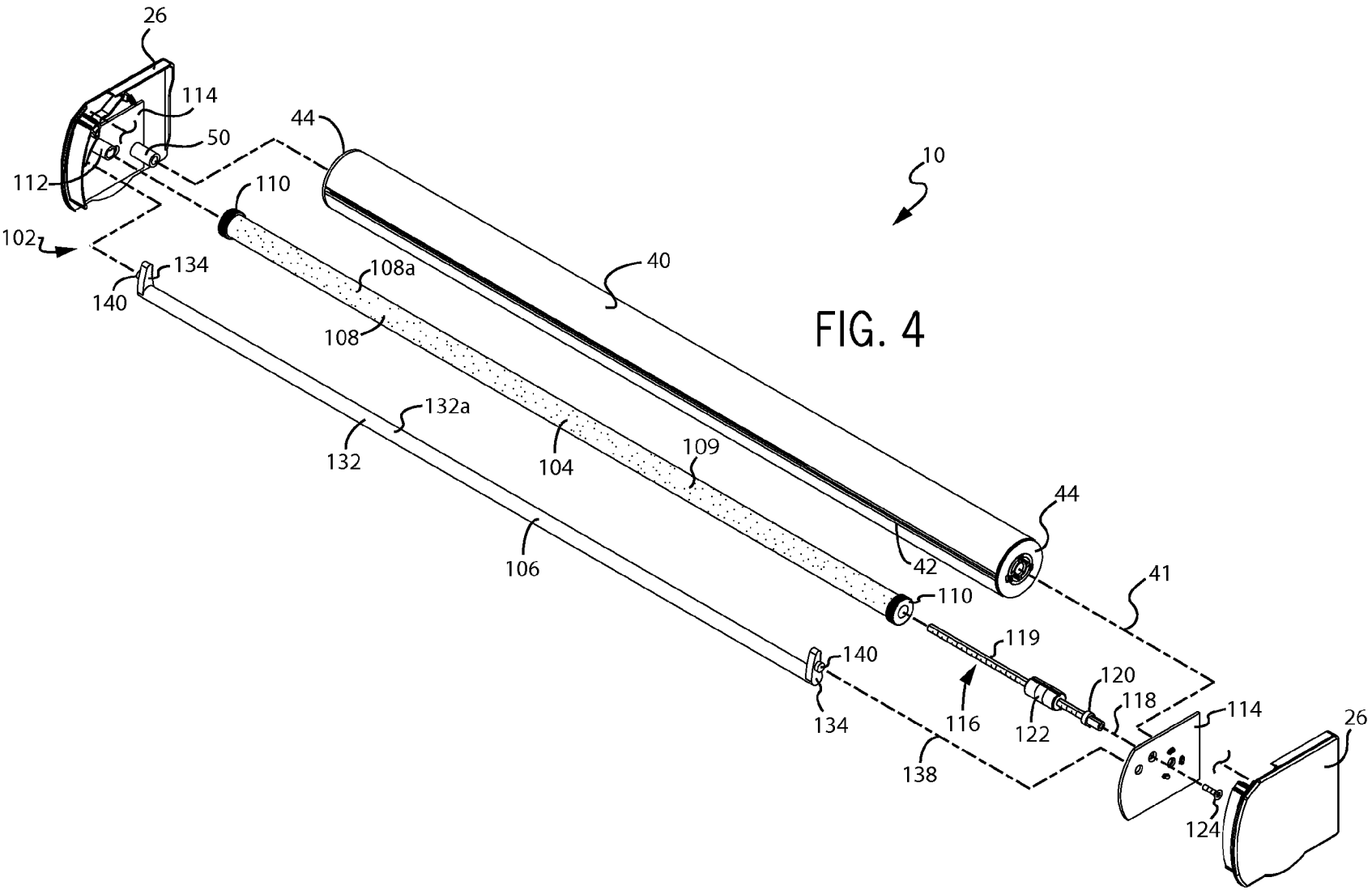
FIG. 4 is a partially-exploded, fragmentary, isometric view of the covering of FIG. 1 with the shade actuator system of FIG. 3.

Referring to FIGS. 3-4, the shade 22 may be operably associated with a roller 40, which may extend longitudinally between, and be rotatably coupled to, opposing end caps 26. Rotational movement of the roller 40 about a longitudinally-extending axis 41 may move the shade 22 between extended and retracted positions. For instance, the shade 22 may be coupled to and wrappable about the roller 40 so that rotation of the roller 40 in a first direction may retract the shade 22 to a position adjacent one or more sides of an associated architectural opening and rotation of the roller 40 in a second, opposite direction may extend the shade 22 across the opening. An upper edge of each of the front and rear sheets 30, 34 of the shade 22 may be coupled to an inwardly-directed, longitudinally extending gland or rib 42. The gland 42 may define an internal cavity that opens through a periphery of the roller 40. The internal cavity of the gland 42 may be configured to receive an upper edge of the shade 22, which may be hemmed and include a strip of material extending longitudinally within a hem-defined pocket.

With reference to FIG. 4, the covering 10 may include bushings 44 associated with each end of the roller 40. The bushings 44 may be rotatably associated with non-rotatable posts 50 that protrude axially from respective mounting brackets 114, which may be removably attached to respective end caps 26. The bushings 44 may be keyed to the roller 40 to rotate in unison with the roller 40 relative to the non-rotatable posts 50. For example, the bushings 44 may extend at least partially into an interior space of the ends of the roller 40. The bushings 44 may include a plurality of circumferentially-spaced, radially-extending ribs 52 (see FIGS. 7 and 9) configured to engage an inner surface of the roller 40 and/or interact with a longitudinally-extending gland 42 formed in the roller 40.

To move the shade 22 between extended and retracted positions, an operator may actuate an operating system (by raising or lowering the bottom rail 18, for example) to wrap or unwrap the shade 22 about or from the roller 40. For example, to retract the shade 22 from an extended position (see FIG. 1), the operator may lift or raise the bottom rail 18 toward the head rail 14. A spring assist module or counterbalancing unit may be positioned within the head rail 14, and, upon an upward movement of the bottom rail 18, the module may rotate the roller 40 in a retraction direction and wind the shade 22 around an outer periphery of the roller 40. To extend the shade 22, the operator may lower or pull downwards on the bottom rail 18, which in turn may unwind the shade 22 from the roller 40. The spring assist module may provide a counterbalancing force that may be substantially equal to the weight of the suspended portion of the shade 22. As such, once the raising or lowering force is ceased, the spring assist module may substantially hold or maintain the shade 22 in the desired position. The spring assist module may be positioned within the roller 40 and may be rotatably associated with an end of the roller 40. Further details regarding the structure and operation of an example spring assist module or counterbalancing unit may be found in International Publication No. WO 2013/033014 A1, which is hereby incorporated by reference herein in its entirety.

In addition or alternatively to the spring assist module, the covering 10 may include a pulley assembly (actuated by an operating element, for example), an electric motor, a combination thereof, or any other suitable drive element or mechanism. In some implementations, the covering 10 may include an electric motor configured to extend or retract the shade 22 upon receiving an extension or retraction command. In these implementations, the covering 10 may include a transceiver operable to communicate with a transmitter, such as a remote control unit. As such, the covering 10 may be operated mechanically and/or electrically.

The shade 22 may include open and closed positions. With reference to FIG. 1, the shade 22 is illustrated in a closed or collapsed position in which the front and rear sheets 30, 34 may be relatively close to one another and the vanes 38 may extend substantially vertically in an approximately coplanar, contiguous relationship with the front and rear sheets 30, 34. With reference to FIG. 2, the shade 22 is illustrated in an open or expanded position in which the front and rear sheets 30, 34 may be laterally spaced from one another and the vanes 38 may extend substantially horizontally between the sheets 30, 34.

To open or expand the shade 22 at substantially any extended position, the covering 10 may include a shade actuator system. With reference to FIGS. 3-4, the shade actuator system 102 may include a shade actuation roller 104 and a locking bar 106, each of which may extend transversely between the end caps 26 across a full width of the shade 22. The shade actuation roller 104 may include an elongate shaft 108 having a rounded outer surface **108*a*, which may be substantially cylindrical. The outer surface 108*a* of the shade actuation roller 104 may be formed as a grip surface 109 so that movement of the shade 22 over the shade actuation roller 104 generally rotates the shade actuation roller 104. The grip surface 109 may extend continuously or discontinuously along the length and/or the circumference of the roller 104. In some implementations, the entire outer surface 108*a* of the shade actuation roller 104 is formed as a grip surface 109 (see FIGS. 4 and 7-10). In some implementations, the grip surface 109 extends continuously around the periphery of the outer surface 108*a* for the full length of the outer surface 108*a*. In some implementations, the grip surface 109 is formed as segments or strips that extend the full length of the outer surface 108*a* and are circumferentially spaced about the outer surface 108*a* of the roller 104. In some implementations, the grip surface 109 is formed as rings that extend continuously around the periphery of the outer surface 108***a* and are spaced axially apart from one another along the length of the roller 104.

A gear or gear form 110 may be attached to one or both ends of the elongate shaft 108 and may rotate in unison with the shaft 108. For example, the gear 110 may be integrally formed with the shaft 108 or separately formed and non-rotatably keyed to the shaft 108. The gear 110 may include a plurality of external, radially-projecting teeth, which may extend substantially parallel to a rotation axis of the gear 110. The gear 110 may be a spur gear, a straight-cut gear, a helical gear, or another suitable gear.

The shade actuation roller 104 may be rotatably coupled to the head rail 14 so that the shade actuation roller 104 rolls or rotates substantially freely with the shade 22. The shade actuation roller 104 may be rotatably supported on opposing ends by stub shafts 112 (see FIGS. 4-6). The stub shafts 112 may extend into opposing ends of the shade actuation roller 104 and may include a substantially cylindrical outer bearing surface on which the ends of the shade actuation roller 104 may rotate. The stub shafts 112 may be attached to respective mounting plates 114, which may be removably secured to the end caps 26. The stub shafts 112 may include an inner wall that defines an inner cavity.

Figure 5:
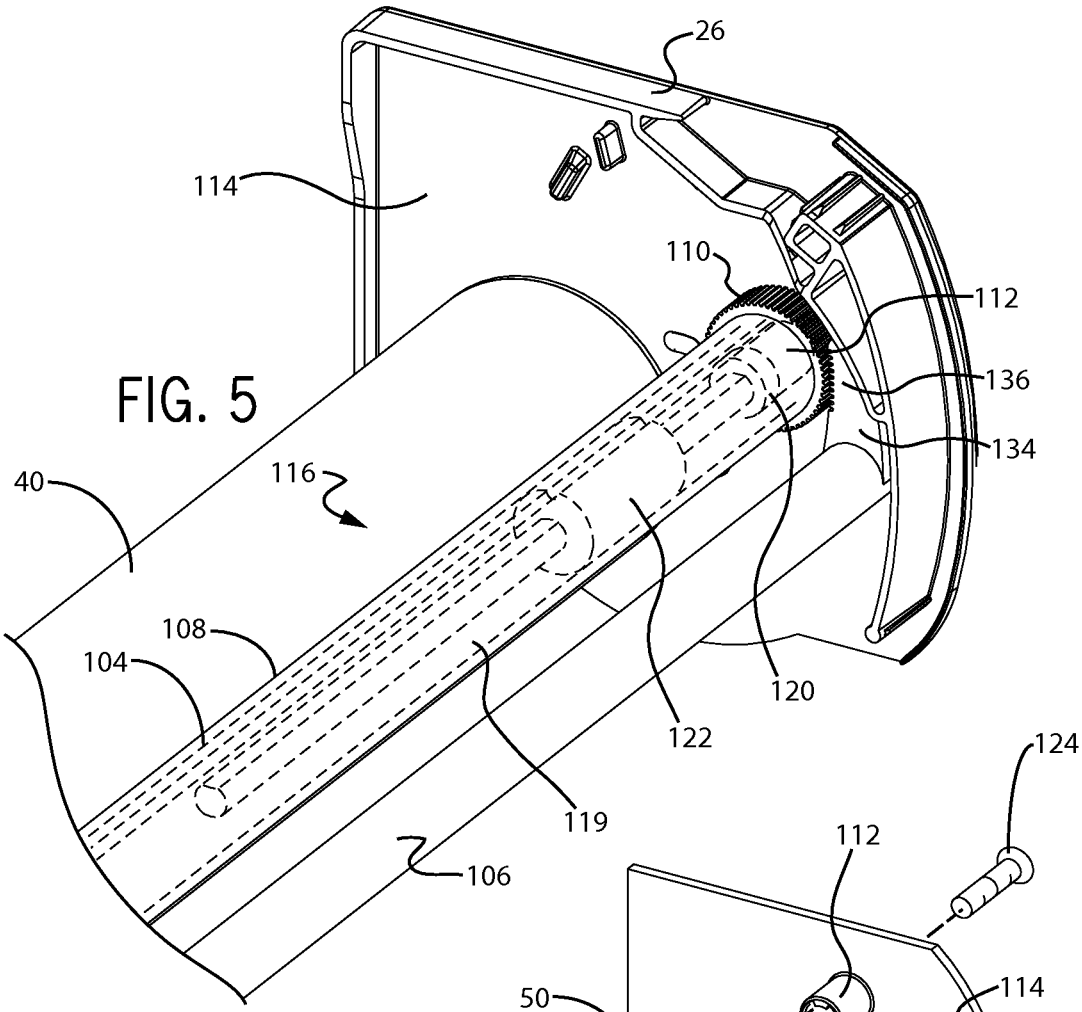
FIG. 5 is a fragmentary, isometric view of the covering of FIG. 1 with the shade actuator system of FIG. 3.
Figure 6:
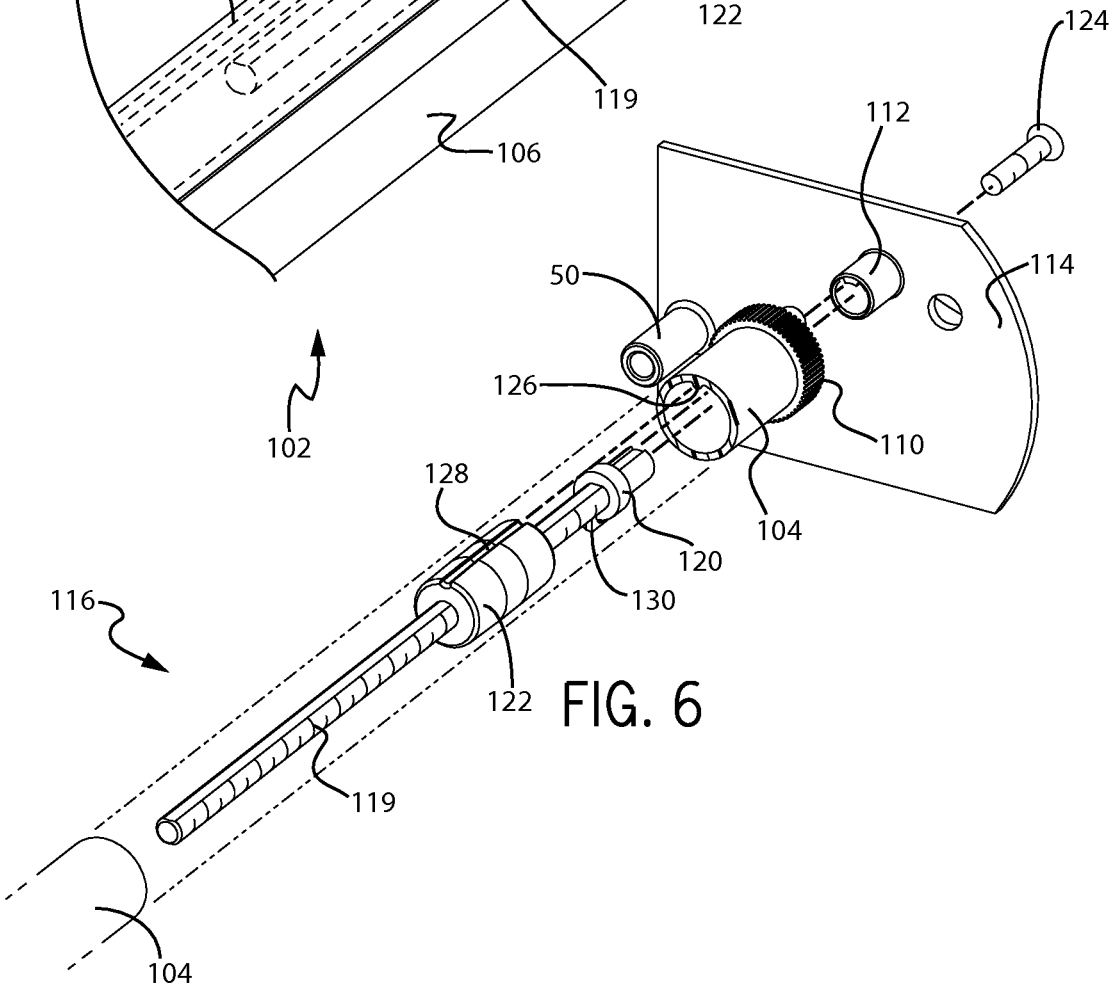
FIG. 6 is a partially-exploded, fragmentary, isometric view of the covering of FIG. 1 with the shade actuator system of FIG. 3.

With reference to FIGS. 4-6, the covering 10 may include a limit assembly 116 configured to set a travel limit or stop for the shade 22. The limit assembly 116 may be positioned within the shade actuation roller 104 by inserting the limit assembly 116 through an opening defined by an end of the shade actuation roller 104. The limit assembly 116 and the roller 104 may be substantially aligned along a longitudinal axis 118 of the roller 104. The limit assembly 116 may be assembled as a single, modular unit. The limit assembly 116 may be added to existing coverings (i.e., retrofit) and may be referred to as a module, system, or unit. The bottom travel limit or stop may be set so that a sufficient or remainder length of the shade 22 remains on the roller 40 upon reaching the bottom stop to permit actuation of the vanes into an open position.

As shown in FIGS. 4-6, the limit assembly 116 may include an externally-threaded, non-rotatable shaft or limit screw 119, a bottom stop 120 attached to the limit screw 119, and a travelable nut 122 threaded onto the limit screw 119. The limit screw 119 may be non-rotatably attached to the end cap 26 via a keyed engagement with the stub shaft 112. A fastener 124 may axially secure the limit screw 118 to the mounting plate 114.

With continued reference to FIGS. 4-6, the bottom stop 120 may be substantially immovable or stationary relative to the limit screw 119. The bottom stop 120 may be formed integrally with, or separately from and fixedly attached to, the limit screw 119. The bottom stop 120 may extend outwardly from a periphery of the threaded limit screw 119 and may form an outwardly-extending abutment flange. A tab may protrude from the bottom stop 120 and may be radially positioned within a rotational path of a lug formed on the travelable nut 122.

The travelable nut 122 may be threaded onto the limit screw 119 and may be non-rotatably keyed to the shade actuation roller 104. The nut 122 may rotate substantially in unison with the shade actuation roller 104, which may cause the nut to translate or travel along a length of the limit screw 119. The nut 122 may include a keying pattern or structure that generally corresponds with a keying pattern or structure defined by an inner surface of the shade actuation roller 104. With reference to FIG. 6, an inner surface of the shade actuation roller 104 may define a longitudinally-extending, inwardly-directed fin 126 configured to be received within a longitudinally-extending slot 128 formed in an outer surface of the nut 122.

During rotation of the roller 104 in a shade raising or retracting direction, the nut 122 may translate axially along the limit screw 119 away from bottom stop 120. Conversely, during rotation of the roller 104 in a shade dispensing or extending direction, the nut 122 may translate axially along the limit screw 119 toward the bottom stop 120. Upon the shade 22 reaching a certain extended position, the nut 122 may contact or engage the bottom stop 120, thereby substantially preventing further rotation of the shade actuation roller 104 as the nut 122 is non-rotatably keyed to the shade actuation roller 104. In one implementation, a lug of the nut 122 may contact a tab of the bottom stop 120 to substantially prevent further rotation, and thus translation, of the nut 122 relative to the limit screw 119 in the shade extension direction.

The limit assembly may include two or more magnets configured to retain the nut 122 in a bottom position adjacent the bottom stop 120. For example, the nut 122 and at least one of the limit screw 119 or the bottom stop 120 may include a magnet configured to interact with one another to hold or retain the nut 122 in the bottom stop position substantially immediately adjacent the bottom stop 120. The magnets may be oriented to attract and hold the bottom position. The magnets may be spaced and/or sized such that the magnets may break or separate apart from one another when the shade 22 is raised. In one implementation, a magnet is secured within a radial protrusion 130 of the bottom stop 120 and a corresponding magnet is secured within the nut 122 to retain the nut 122 in a bottom position adjacent the bottom stop 120.

With reference to FIGS. 3-5, the locking bar 106 may include an elongate shaft 132 having a rounded outer surface 132*a*, which may be substantially cylindrical. A locking lever 134 may be attached to one or both ends of the elongate shaft 132. The locking lever 134 may be integrally formed with the shaft 132 or separately formed and non-rotatably keyed to the shaft 132. The locking lever 134 may include a toothed portion 136 having one or more teeth positioned along a side of the locking lever that generally confronts the gear 110 of the shade actuation roller 104. In some implementations, the locking lever 134 includes a plurality of gear teeth that correspond to the gear 110. The teeth may extend substantially parallel to a pivot axis 138 of the locking bar 106 (see FIG. 4).

The locking bar 106 may be rotatably supported on opposing ends by the end caps 26. The locking bar 106 may include a pivot pin 140 projecting from a lateral side of each locking lever 136. The pivot pin 140 may be journaled within the mounting plates 114 and may define the pivot axis 138 of the locking bar 106 (see FIG. 4). The elongate shaft 132 and the toothed portion 136 of the locking bar 106 may be offset from the pivot axis 138 of the locking bar 106 and may be positioned on generally opposite sides of the pivot axis 138 relative to one another. A biasing element may be associated with the locking bar 106 to bias the toothed portion 136 away from the gear 110. For example, a torsion spring may be positioned around the pivot pin 140 and may interact with the mounting plate 114 or the end cap 26 to bias the locking lever 136 out of engagement with the gear 110.

With reference to FIGS. 3, 4, 7, and 9, the longitudinal axis 118 of the shade actuation roller 104 may be positioned forward and upward of the longitudinal axis 41 of the roller 40, and the pivot axis 138 of the locking bar 106 may be positioned forward and downward of the longitudinal axis 118 of the shade actuation roller 104. The longitudinal axes

41, 118, 138 of the roller 40, the shade actuation roller 104, and the locking bar 106 may be substantially parallel to one another.

Figure 7:
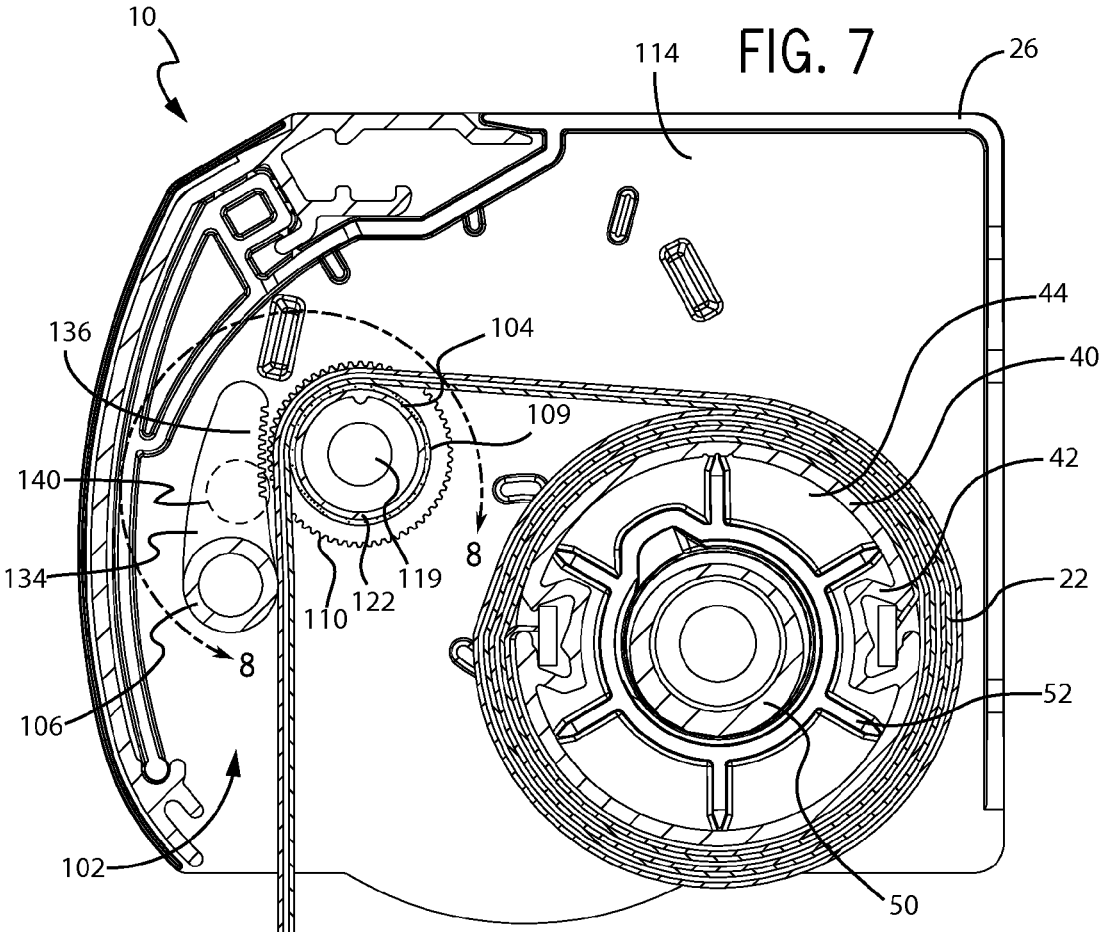
FIG. 7 is a transverse section view of the covering of FIG. 1 taken along the line 7-7 illustrated in FIG. 1 with the shade actuator system of FIG. 3.
Figure 9:
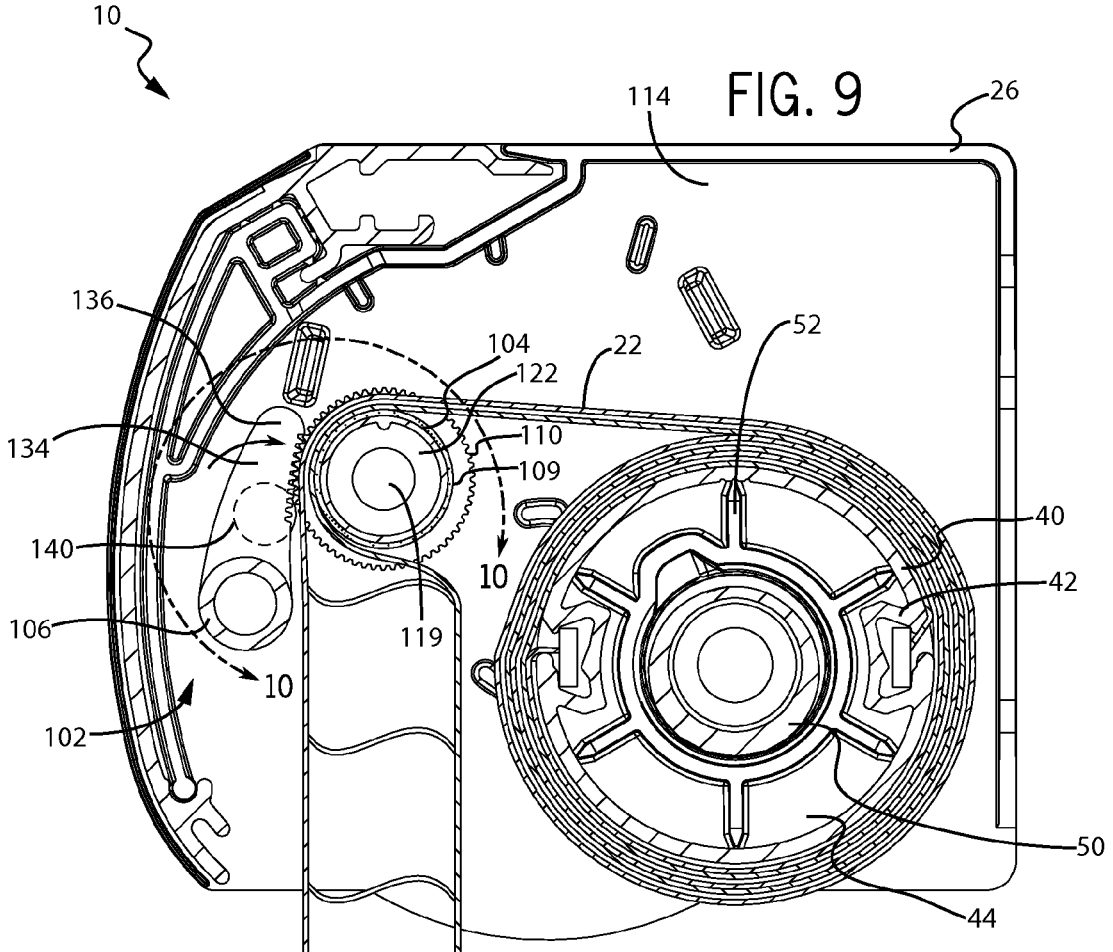
FIG. 9 is a transverse section view of the covering of FIG. 1 taken along the line 9-9 illustrated in FIG. 9 with the shade actuator system of FIG. 3.
Figure 10:
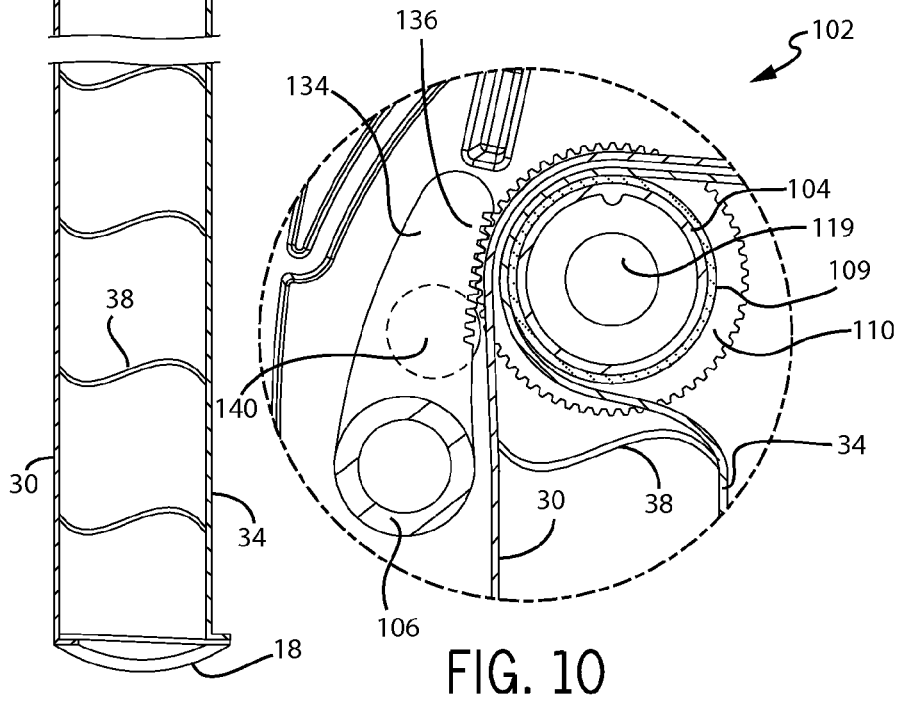
FIG. 10 is an enlarged view of the covering of FIG. 1 taken along the line 10-10 illustrated in FIG. 9 with the shade actuator system of FIG. 3.

With reference to FIGS. 3, 7, and 9, the shade 22 may be unwrapped from a top portion of the roller 40 in a forward direction, draped over the shade actuation roller 104, and extend downward from a front side of the shade actuation roller 104. The shade actuation roller 104 and the locking bar 106 may be positioned on opposite sides of the shade 22. The shade actuation roller 104 may be positioned forward of the roller 40 and underneath the shade 22 such that the shade actuation roller 104 may abut or contact the rear sheet 34 of the shade 22. The elongate shaft 132 of the locking bar 106 may be positioned forward of the shade 22, and the elongate shaft 132 may abut or contact the front sheet 30 of the shade 22. The gears 110 and the locking levers 134 may be positioned laterally outward of the side edges of the shade 22 so as to not interfere with movement of the shade 22. That is, the shade 22 may be draped over the shade actuation roller 104 laterally between the gears 110 and may extend rearward of the elongate shaft 132 of the locking bar 106. In an alternative implementation, the arrangement of the roller 40, the shade actuation roller 104, and the locking bar 106 may be flipped from front to back so that the shade 22 is unwrapped from a top portion of the roller 40 in a rearward direction.

Figure 8:
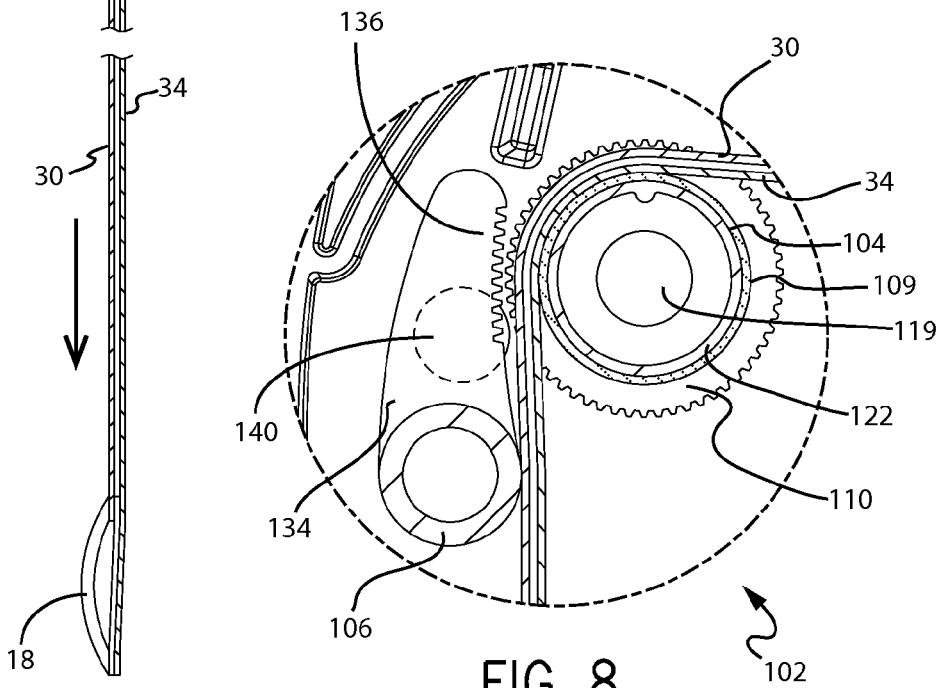
FIG. 8 is an enlarged view of the covering of FIG. 1 taken along the line 8-8 illustrated in FIG. 7 with the shade actuator system of FIG. 3.

With reference to FIGS. 7-8, the shade 22 is wrapped around the roller 40, draped over the shade actuation roller 104, and extended substantially vertically downward from the shade actuation roller 104. To extend the shade 22, the operator may pull downwardly on the bottom rail 18, which may rotate the shade actuation roller 104 about its longitudinal axis 118. To open or expand the shade 22 from the depicted closed position, the operator may rotationally lock the rotation of the shade actuation roller 104 when the shade 22 is in a desired extended position. For instance, the operator may grasp the bottom rail 18 and/or the shade 22 and pull the shade 22 forwardly into an associated room, causing the shade 22 to contact the elongate shaft 132 and pivot the locking bar 106, resulting in the toothed portion 136 of the locking lever 134 engaging the gear 110 of the shade actuation roller 104, thereby substantially preventing rotation of the shade actuation roller 104. An engagement between the toothed portion 136 and the gear 110 may retain the locking lever 134 in the locked position until repositioning of the shade 22 is desired.

Once the shade actuation roller 104 is rotationally locked, the operator may pivot the bottom rail 18 from the depicted substantially vertical orientation toward a horizontal orientation, which may pull the front sheet 30 over the top of the shade actuation roller 104 relative to the back sheet 34. The back sheet 34 may be substantially prevented from moving over the shade actuation roller 104 due to the grip surface 109 of the shade actuation roller 104. As such, an extra length of the front sheet 30 may be extended downward from the shade actuation roller 104 relative to the rear sheet 34, which may result in the vanes 38 separating the front and rear sheets 30, 34 as illustrated in FIG. 9. The vanes 38 may resiliently bias the front and rear sheets 30, 34 away from each other. As illustrated in FIG. 9, the biasing force of the vanes 38 may wrap a portion of the rear sheet 34 around a bottom portion of the shade actuation roller 104. To close the shade 22, and thus the vanes 38, the operator may tug down slightly on the shade 22 to release the engagement of the toothed portion 136 of the lever lock 134 and the gear 110 of the shade actuation roller 104. Once the lever lock 134 is disengaged from the gear 110, the spring assist module in the roller 40 may hold or maintain the shade 22 in position until the bottom rail 18 is lifted, at which point the spring assist module may retract the shade 22 and wind the shade 22 around the roller 40. In some implementations, upon the locking bar 106 stopping the rotation of the shade actuation roller 104, further rotation of the roller 40 may cause the rear sheet 34 to bulge downwardly between the roller 40 and the actuation roller 104 and the shade 22 may hang substantially centered relative to a front, tangential edge of the actuation roller 104.

FIGS. 11-12 illustrate a second example of a shade actuator system 202. The preceding discussion of the features and operation of the shade actuator system 102 should be considered equally applicable to the shade actuator system 202, except as noted in the following discussion. The reference numerals used in FIGS. 11-12 generally correspond to the reference numbers used in FIGS. 1-10 to reflect similar parts and components.

With reference to FIGS. 11-12, the shade actuator system 202 is illustrated in two operational positions: a disengaged position (FIG. 11) and an engaged position (FIG. 12). In the disengaged position (FIG. 11), a grip surface 209 of the shade actuator system 202 may be rotated away from the rear shade 34 in a counterclockwise direction to permit extension and retraction of the shade 22 without interference from the grip surface 209. In the engaged position (FIG. 12), the grip surface 209 of the shade actuator system 202 may be engaged with a rear sheet 34 of the shade 22, thereby obstructing the generally downward motion of the rear sheet 34 off of a front side of the shade actuation roller 204, which may cause the shade 22 to open or expand under the influence of the bottom rail 18 (FIGS. 1-2), the vanes 38 (FIG. 12), or both. To rotate the shade actuation roller 204 about its longitudinal axis, a drive system may be operably associated with the roller 204. The drive system may include a pulley system, a motor, or other suitable drive systems. The drive system may be actuated mechanically or electrically.

With continued reference to FIGS. 11-12, the shade actuator system 202 may include a shade actuation roller 204, which may extend transversely between the end caps 26 across a full width of the shade 22. The shade actuation roller 204 may include an elongate shaft 208 having a rounded outer surface 208*a*, which may be substantially cylindrical. The outer surface 208*a* may include two surfaces with different coefficient of frictions: a grip surface 209 and a slide surface 213. The grip and slide surfaces 209, 213 may collectively form substantially the entire periphery of the outer surface 208*a*. The angular size or range of the respective surfaces 209, 213 may vary. In some implementations, the grip surface 209 may extend around the shade actuation roller 204 between about 5 degrees and about 180 degrees of the outer surface 208*a*, with the slide surface 213 forming the remainder of the outer surface 208*a*.

The shade actuation roller 204 may be selectively rotatable about its longitudinal axis to selectively engage or disengage the grip surface 209 with the rear sheet 34 of the shade 22. When the slide surface 213 is in contact with the rear sheet 34, the surface 213 may permit the rear sheet 34 to substantially freely slide over the surface 213. Conversely, when the grip surface 209 is in contact with the rear sheet 34, the grip surface 209 may substantially prevent the rear sheet 34 from moving relative to the grip surface 209, which, as previously discussed, may result in the opening or expanding of the shade 22.

With continued reference to FIGS. 11-12, when substantially uninhibited shade extension or retraction is desired, an operator may orient the shade actuation roller 204 so that the shade 22 passes over the slide surface 213. To open the shade 22 at substantially any extended position, the operator may rotate the shade actuation roller 204 to engage the grip surface 209 with the rear sheet 34 of the shade 22. The grip surface 209 of the shade actuation roller 204 may substantially prevent the rear sheet 34 from moving, and thus the vanes 38 may open as a result of the relative movement between the front and rear sheets 30, 34.

FIGS. 13-14 illustrate a third example of a shade actuator system 302. The preceding discussion of the features and operation of the shade actuator system 102, 202 should be considered equally applicable to the shade actuator system 302, except as noted in the following discussion. The reference numerals used in FIGS. 13-14 generally correspond to the reference numbers used in FIGS. 1-12 to reflect similar parts and components.

With reference to FIGS. 13-14, the shade actuator system 302 is illustrated in two operational positions: a disengaged position (FIG. 13) and an engaged position (FIG. 14). In the disengaged position (FIG. 14), a grip surface 309 of the shade actuator system 302 may be rotated away from the rear shade 34 in a counterclockwise direction to permit extension and retraction of the shade 22 without interference from the grip surface 309. In the engaged position (FIG. 14), the grip surface 309 of the shade actuator system 302 may be engaged with a rear sheet 34 of the shade 22, thereby obstructing the generally downward motion of the rear sheet 34 off of a front side of the shade actuation roller 304, which may cause the shade 22 to open or expand under the influence of the bottom rail 18 (FIGS. 1-2), the vanes 38 (FIG. 14), or both. To rotate the shade actuation roller 304 about its longitudinal axis, a drive system may be operably associated with the roller 304. The drive system may include a pulley system, a motor, or other suitable drive systems. The drive system may be actuated mechanically or electrically.

With continued reference to FIGS. 13-14, the shade actuator system 302 may include a shade actuation roller 304, which may extend transversely between the end caps 26 across a full width of the shade 22. The shade actuation roller 304 may include an elongate shaft 308 having a rounded outer surface 308*a*, which may be substantially cylindrical. The outer surface 308*a* may include a slide surface 213 extending over a majority of the outer surface 308*a* of the roller 304. A protrusion 315 may extend outward from the outer surface 308*a* of the shade actuation roller 304 and may extend lengthwise along the elongate shaft 308. The protrusion may extend continuously or discontinuously along substantially the entire length of the elongate shaft 308. The protrusion 315 may be rigid or semi-rigid. The protrusion 315 may be permanently attached to the roller 304 or may be removeably attached to the roller 304 for maintenance purposes. In some implementations, the protrusion 315 is removeably fit into a slot formed in the roller 304 or otherwise secured to the roller 304. A grip surface 309 may be associated with a confronting face of the protrusion 315 relative to the rear sheet 34 of the shade 22. In some implementations, the entire protrusion 315 may be considered a grip surface 309 of the roller 304.

The shade actuation roller 304 may be rotatable about its longitudinal axis to selectively engage or disengage the grip surface 309 of the protrusion 315 with or from the rear sheet 34 of the shade 22. When the slide surface 308*a* is in contact with the rear sheet 34, the surface 308*a* may permit the rear sheet 34 to substantially freely slide over the surface 308*a*. Conversely, when the protrusion 315 is in contact with the rear sheet 34, the grip surface 309 may substantially prevent the rear sheet 34 from moving relative to the protrusion 315, which, as previously discussed in relation to the shade actuator systems 102 and 202, may result in the opening or expanding of the shade 22.

With continued reference to FIGS. 13-14, when substantially uninhibited shade extension or retraction is desired, an operator may rotate the shade actuation roller 304 to disengage the protrusion 315, and thus the grip surface 309, from the shade 22. In this orientation, the shade 22 may pass over the slide surface 208*a* of the shade actuation roller 304. To open the shade 22 at substantially any extended position, the operator may extend or retract the shade 22 to a desired position. Then, the operator may rotate the shade actuation roller 304 so that the grip surface 309 of the protrusion 315 frictionally engages the rear sheet 34 of the shade 22. After engagement of the protrusion 315 and the rear sheet 34, the front sheet 30 may be moved relative to the rear sheet 34 by pivoting the bottom rail 18, which may allow the shade 22 to open or expand.

Figure 15:
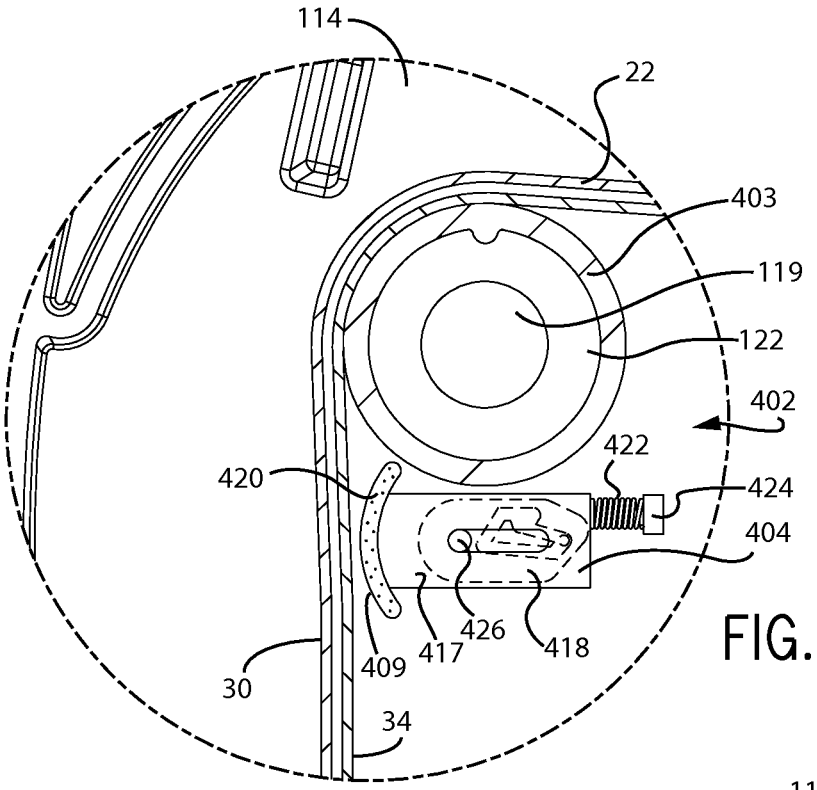
FIG. 15 is an enlarged view of the covering of FIG. 1 taken along the line 8-8 illustrated in FIG. 7 with another example shade actuator system.
Figure 16:
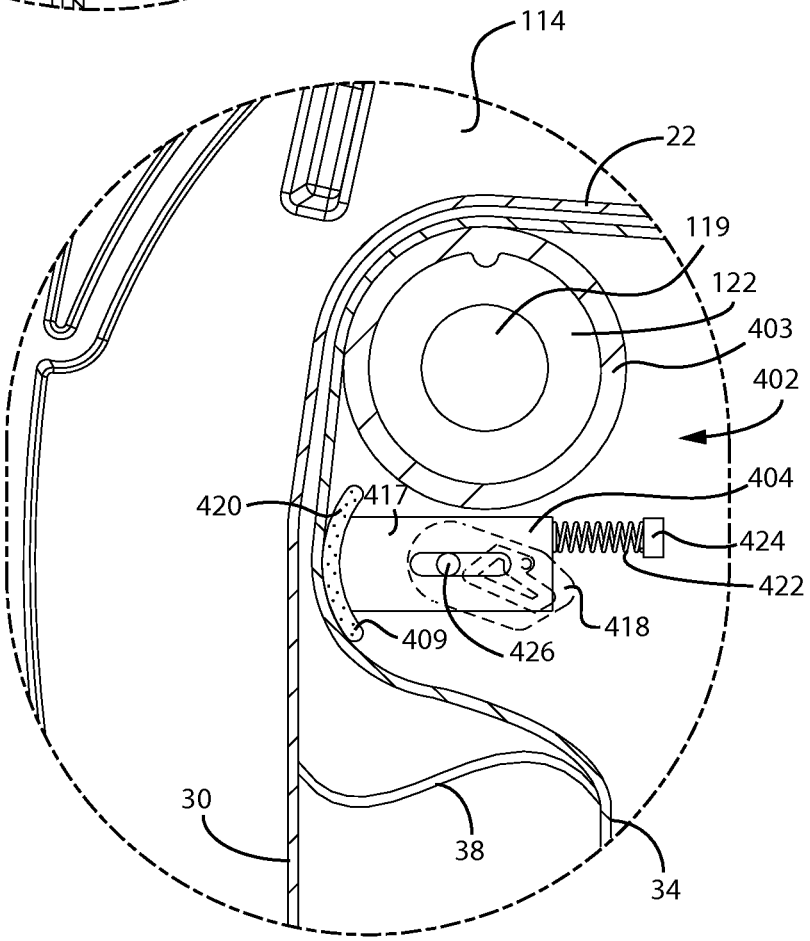
FIG. 16 is an enlarged view of the covering of FIG. 1 taken along the line 10-10 illustrated in FIG. 9 with the shade actuator system of FIG. 15.
Figure 17:
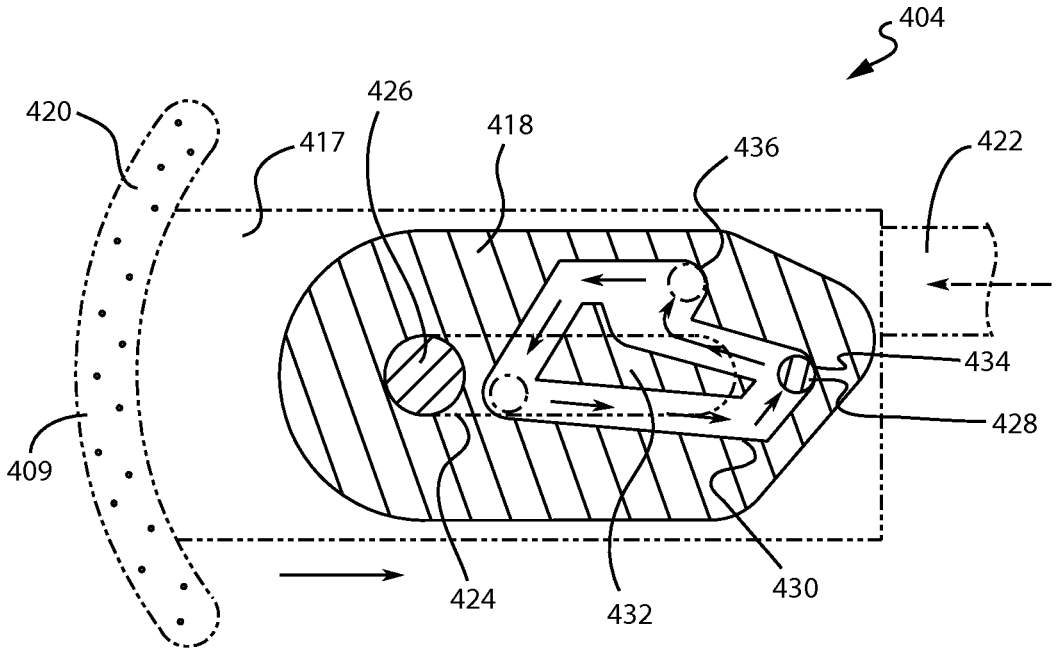
FIG. 17 is an enlarged view of the shade actuator system of FIG. 15.

FIGS. 15-17 illustrate a fourth example of a shade actuator system 402. The preceding discussion of the features and operation of the shade actuator system 102, 202, 302 should be considered equally applicable to the shade actuator system 402, except as noted in the following discussion. The reference numerals used in FIGS. 15-16 generally correspond to the reference numbers used in FIGS. 1-14 to reflect similar parts and components.

With reference to FIGS. 15-16, the shade actuator system 402 is illustrated in two operational positions: a disengaged position (FIG. 15) and an engaged position (FIG. 16). In the disengaged position (FIG. 15), a grip surface 409 of the shade actuator system 402 may be translated away from the rear shade 34 to permit extension and retraction of the shade 22 without interference from the grip surface 409. In the engaged position (FIG. 16), the grip surface 409 of the shade actuator system 402 may be engaged with a rear sheet 34 of the shade 22, thereby obstructing the generally downward motion of the rear sheet 34 off of a front side of the roller 404, which may cause the shade 22 to open or expand under the influence of the bottom rail 18 (FIGS. 1-2), the vanes 38 (FIG. 16), or both.

The grip surface 409 may be selectively slidable towards the shade 22 to selectively engage the grip surface 409 with the rear sheet 34 of the shade 22. When the grip surface 409 is spaced from the rear sheet 34, the rear sheet 34 may substantially freely slide over the guide 403. Conversely, when the grip surface 409 engages the rear sheet 34, the grip surface 409 may substantially prevent the rear sheet 34 from moving relative to the grip surface 409, which, as previously discussed in relation to the shade actuator systems 102, 202, 302, may result in the bottom rail 18, the vanes 38, or both laterally separating the suspended portions of the front and rear sheets 30, 34, thereby opening or expanding the shade 22.

With continued reference to FIGS. 15-16, the shade actuator system 402 may include a guide 403 and a shade actuation slider mechanism 404, both of which may extend transversely between the end caps 26 across a full width of the shade 22. The guide 403 may be rotatably or non-rotatably supported by the end caps 26. The slider mechanism 404 may be slidably supported by the end caps 26. The guide 403 may include an elongate shaft 408 having a rounded outer surface 408*a*, which may be substantially cylindrical. The outer surface 408*a* of the guide 403 may be generally smooth and may allow the rear sheet 34 to slide over the guide 403 substantially uninhibited. That is, the outer surface 408*a* of the guide 403 may be formed as a slide surface. In some implementations, the shade actuator system 402 does not include the guide 403. In these implementations, the slider mechanism 404 may be positioned below the roller 40. In some implementations, the shade actuator system 420 is operably coupled to opposing ends of the guide 403 to provide selective engagement or disengagement of the guide 403 with the shade 22. In these implementations, the slider mechanism 404 and the guide 403 may be positioned below the roller 40.

With reference to FIGS. 15-17, the shade actuation slider mechanism 404 may include a slider plate 417, a positioning device or key 418, a contact rail 420, a biasing element 422, and an abutment wall 424. The slider plate 417, the positioning device 418, the biasing element 422, and the abutment wall 424 may be provided for each end cap 26. The contact rail 420 may extend transversely between the end caps 26 substantially across a full width of the shade 22 and may attach at opposing ends to the respective slide plates 417 associated with the opposing end caps 26. The contact rail 420 may have an arcuate or curved transverse cross-section. The contact rail 420 may be formed as a grip surface 409 or may include a grip 409 on a confronting face relative to the shade 22.

The slider plate 417 may be slidable relative to the end cap 26, the mounting plate 114, and/or the positioning device 418. With reference to FIG. 17, a slot 424 may be formed within a periphery of the slider plate 417 and may extend axially along a length of the slider plate 417 in a generally transverse direction relative to the contact rail 420. The slot 424 may be configured to receive a retainer axle 426 protruding outward from the end plate 26, the mounting plate 114, or both. The retainer axle 426 may at least partially locate the slider plate 417 relative to the end cap 26, the mounting plate 114, or both. The retainer axle 426 may limit the amount of axial travel of the slide plate 417 to the length of the slot 424 as the retainer axle 426 may be constrained within the slot 424. Additionally or alternatively, longitudinal edges of the slider plate 417 may be received within side tracks associated with the end cap 26, the mounting plate 114, or both. As such, the slider plate 417 may be substantially constrained to axial movement limited by the length of the slot 424. The slider plate 417 also may include a cam or positioning pin 428 that protrudes outward from a bearing face of the slider plate 417. The positioning pin 428 may extend into pathway or channel 430 defined by the positioning device 418.

The positioning device 418 may be pivotable relative to the end cap 26, the mounting plate 114, and/or the slider plate 417. With reference to FIG. 17, the positioning device 418 may be pivotably mounted about the retainer axle 426. The positioning device 418 may define an axle aperture that snugly receives the retainer axle 426, thereby substantially preventing translation of the positioning device 418 relative to the end cap 26, the mounting plate 114, or the slider plate 417.

With continued reference to FIG. 17, the pathway or channel 430 defined by the positioning device 418 may be recessed into a face of the positioning device 418 that confronts the positioning pin 428 of the slider plate 417. The pathway 430 may form a closed loop path and may define a directing island 432 or engagement features, which similarly help to define the channel 430. The directing island 432 may be shaped generally as an acute triangle having rounded edges and a recess defined on a bottom edge.

With continued reference to FIG. 17, the positioning pin 428 of the slider plate 417 may be travelable within the pathway 430. As the slider plate 417 may be limited to axial travel along a lengthwise direction of the slot 424, the positioning pin 428 similarly may be limited to axial travel. As such, the positioning pin 428 may contact the sidewalls of the directing island 432 during axial movement of the slider plate 417 relative to the positioning device 418 and pivot the positioning device 418 about the retainer axle 426 (see the locations of the positioning pin 428 and the positioning device 418 in FIGS. 15 and 16).

The orientation of the sidewalls of the directing island 432 relative to one another may create diversion peaks that may be off-center relative to a seating position of the positioning pin 428 within the pathway 430 (see FIG. 17 in which three seating positions are depicted). The off-center nature of the diversion peaks directs or diverts the positioning pin 428 in a set direction around the directing island 432. For example, in FIG. 17, the orientation of the sidewalls of the directing island 432 generally directs or diverts the positioning pin 428 in a counterclockwise direction around the island 432.

The configuration of the pathway 430 of the positioning device 418 and the positioning pin 428 of the slider plate 417 may create a consistent, reliable, and repeatable mechanism that moves the contact rail 420, and thus the grip surface 409, axially toward and away from the shade 22 and provides several seated positions for the contact rail 420. For example, with reference to FIG. 15, the contact rail 420 is positioned in a disengaged position in which the contact rail 420 is axially spaced apart from the shade 22 and the positioning pin 428 is seated in a first recessed pocket 434 of the pathway 430 (see FIG. 17) under the bias of the biasing element 422. With reference to FIG. 16, the contact rail 420 is positioned in an engaged position in which the contact rail 420 engages the rear sheet 34 of the shade 22 and the positioning pin 428 is seated in a second recessed pocket 436 of the pathway 430 (see FIG. 17) under the bias of the biasing element 422.

To move the slider plate 417 between the different seated positions, and thus the contact rail 420 toward and away from the shade 22, a drive system may be operably associated with the shade actuation slider mechanism 404. The drive system may include a pulley system, a solenoid, or other suitable drive systems. The drive system may be actuated mechanically or electrically. In one implementation, a control cord is used to move the shade actuation slider mechanism 404 between the various seated positions.

With reference to FIGS. 15-16, when substantially uninhibited shade extension or retraction is desired, an operator may translate the slider plate 417 to disengage the contact rail 420, and thus the grip surface 409, from the shade 22. In this position, the shade 22 may pass forward of the contact rail 420 of the shade actuation slider mechanism 404. To open the shade 22 at substantially any extended position, the operator may extend or retract the shade 22 to a desired position. Then, the operator may translate the slider plate 417 so that the grip surface 309 of the contact rail 420 frictionally engages the rear sheet 34 of the shade 22. After engagement of the contact rail 420 and the rear sheet 34, the front sheet 30 may be moved relative to the rear sheet 34 by pivoting the bottom rail 18, which may allow the shade 22 to open or expand.

FIGS. 18-24 illustrate a fifth example of a shade actuator system 502. The preceding discussion of the features and operation of the shade actuator system 102, 202, 302, 402 should be considered equally applicable to the shade actuator system 502, except as noted in the following discussion. The reference numerals used in FIGS. 18-24 generally correspond to the reference numbers used in FIGS. 1-17 to reflect similar parts and components.

Figure 1A:
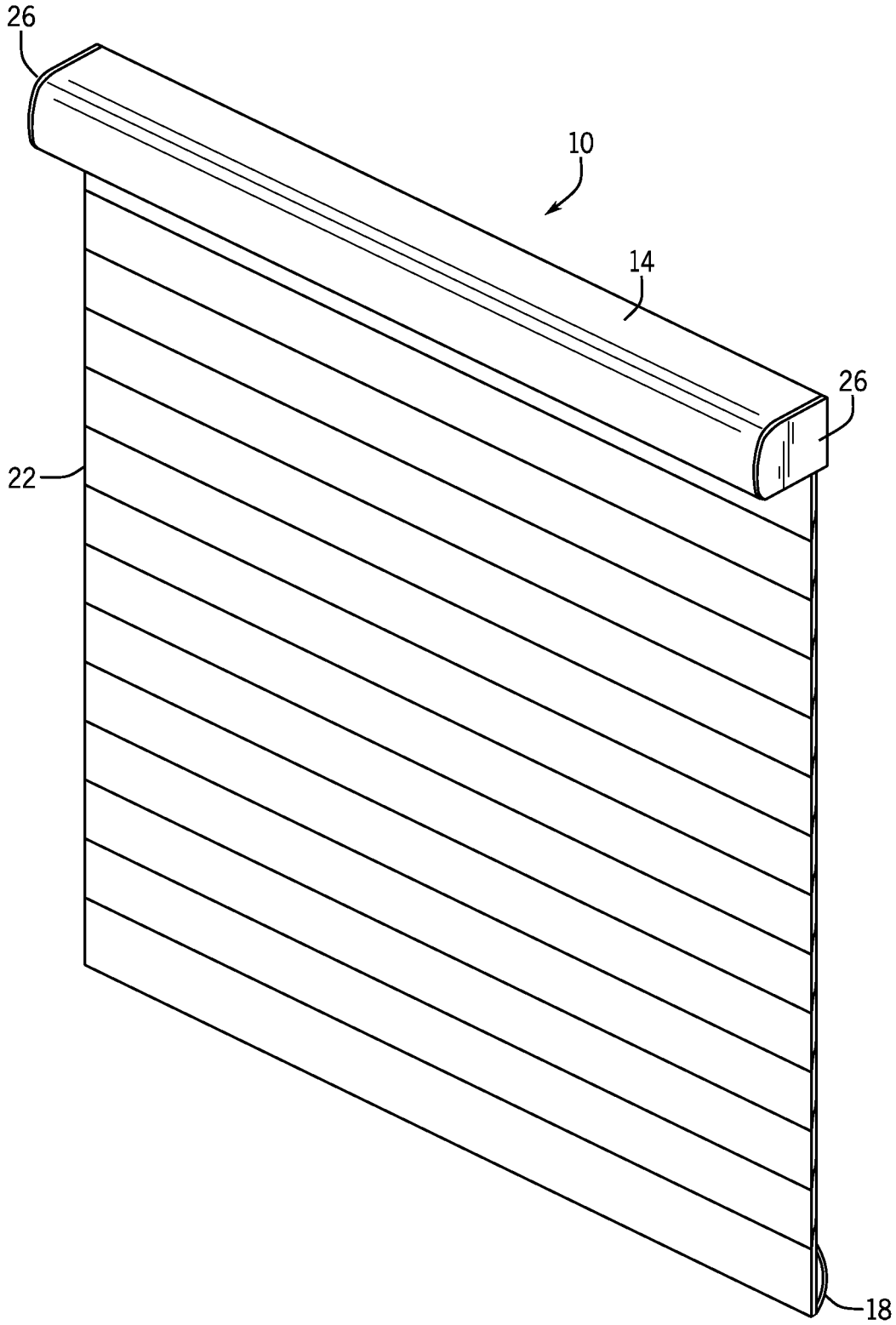
FIG. 1A is an isometric view of a covering with a shade extended from a rear portion of a head rail and oriented in a closed or collapsed position.
Figure 18:
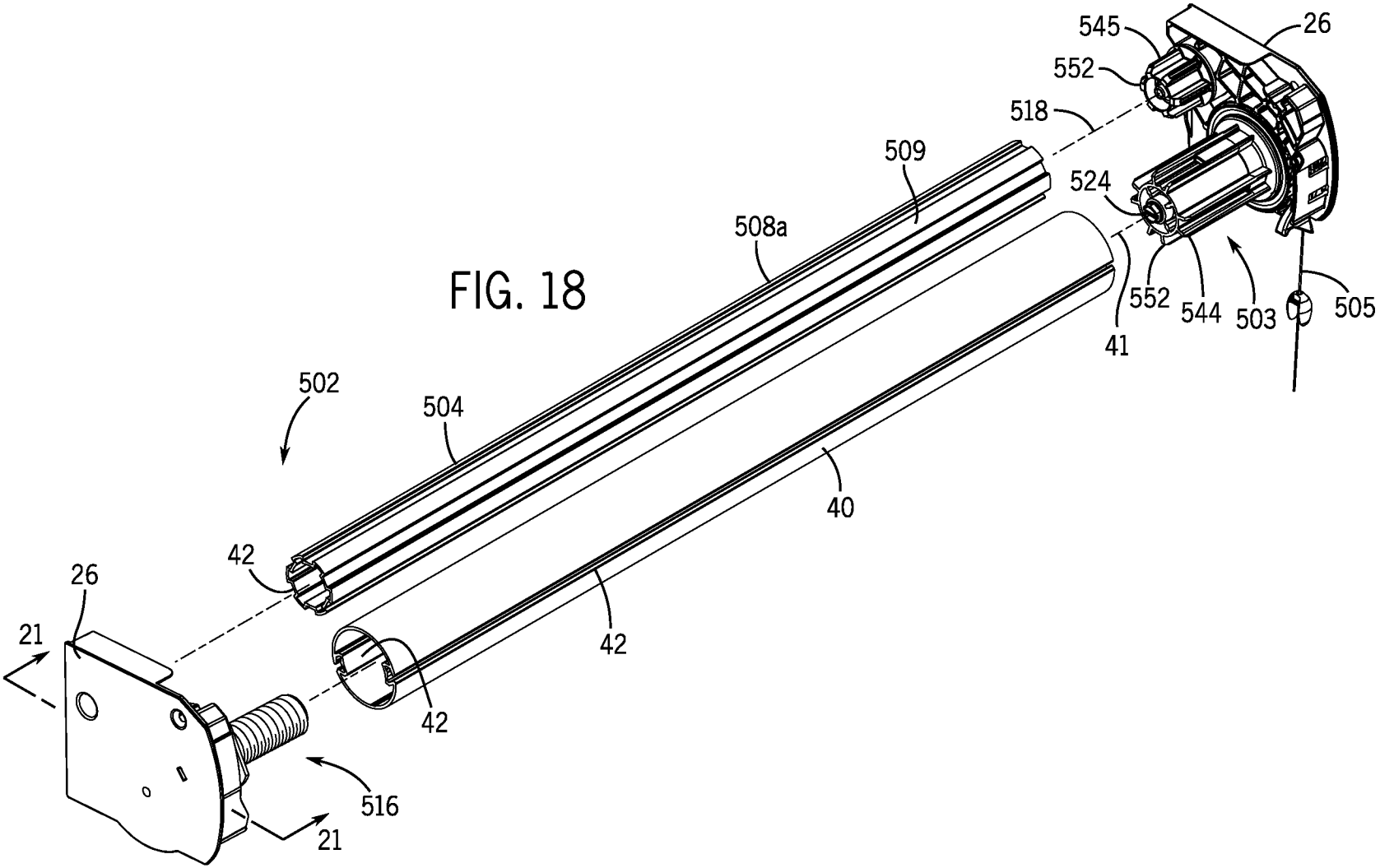
FIG. 18 is a fragmentary, isometric view of the covering of FIG. 1A with another example shade actuator system.

Referring to FIG. 18, the shade actuator system 502 may be operably associated with two rollers: a first or accumulator roller 40 and a second or shade actuation roller 504. The accumulator roller 40 may extend longitudinally between, and be rotatably coupled to, opposing end caps 26, and may be formed as a tube. The shade 22 (see FIGS. 1A-2) may be attached to the roller 40 such that rotational movement of the roller 40 about its longitudinally-extending axis 41 may move the shade 22 between extended and retracted positions. For instance, rotation of the roller 40 in a first direction may retract the shade 22 to a position adjacent one or more sides of an associated architectural opening and rotation of the roller 40 in a second, opposite direction may extend the shade 22 across the opening. An upper edge of each of the front and rear sheets 30, 34 of the shade 22 (see FIG. 2) may be coupled to an inwardly-directed, longitudinally extending gland or rib 42.

With continued reference to FIG. 18, the shade actuation roller 504 may be offset from the accumulator roller 40 in generally parallel relationship to the roller 40. The shade actuation roller 504 may be formed as a tube and may be substantially cylindrical. The shade actuation roller 504 may extend longitudinally between, and be rotatably coupled to, the end caps 26. The shade 22 may be draped over the shade actuation roller 504 and extended downwardly from a rear side of the roller 504.

Figure 19:
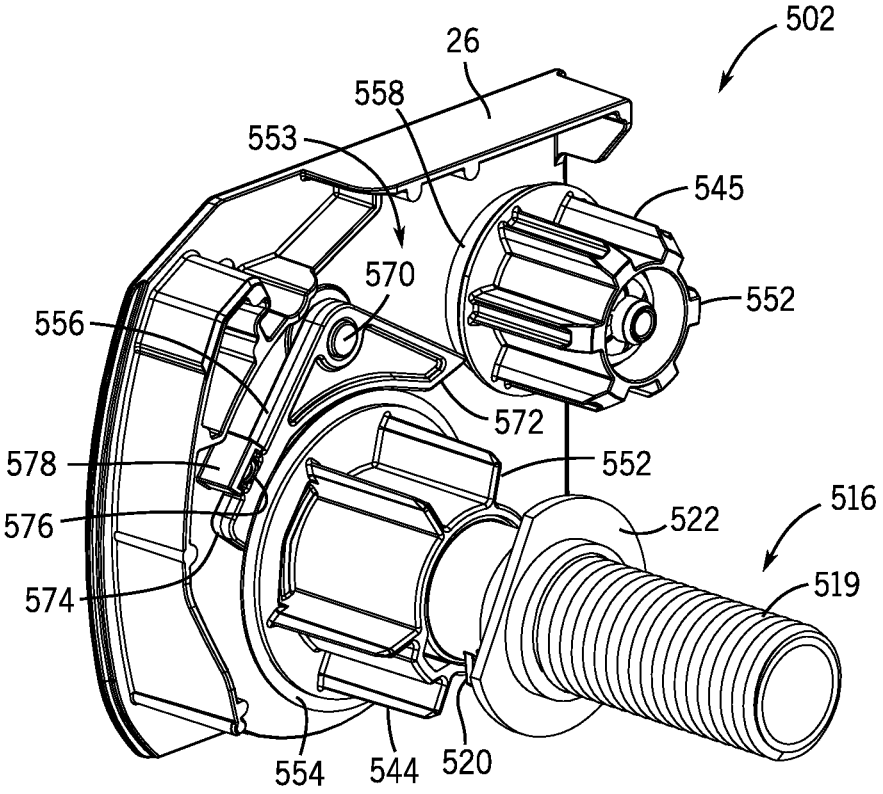
FIG. 19 is an isometric view of the shade actuator system of FIG. 18.
Figure 20:
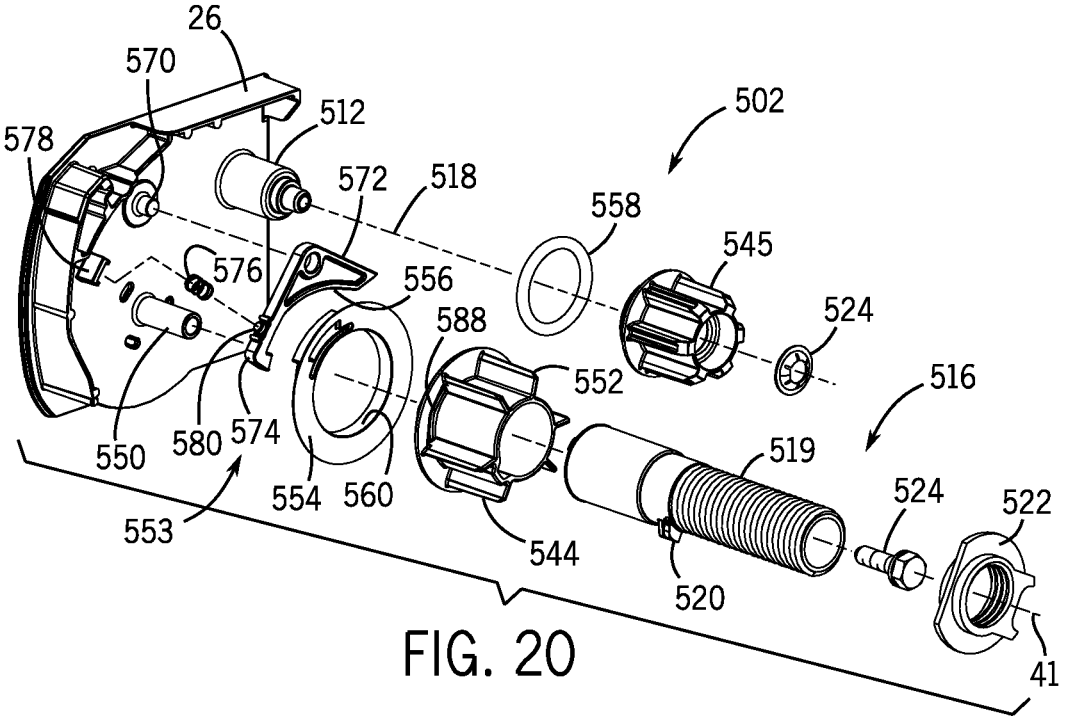
FIG. 20 is an exploded, isometric view of the shade actuator system of FIG. 18.

With reference to FIGS. 18 and 19, opposing ends of the rollers 40, 504 may be supported by bushings 544, 545, respectively. The bushings 544, 545 may be keyed to the rollers 40, 504 to rotate in unison with the rollers 40, 504, respectively, relative to the end caps 26. The bushings 544, 545 may extend at least partially into an interior space of the ends of the rollers 40, 504, respectively. The bushings 544, 545 may include a plurality of circumferentially-spaced, radially-extending ribs 552 configured to engage an inner surface of the rollers 40, 504 and/or interact with longitudinally-extending glands 42 formed in the rollers 40, 504, respectively. Referring to FIG. 20, the bushings 545 may be supported by and rotatable relative to a stub shaft 512 protruding axially from the end caps 26. The bushings 545 may be axially secured to the stub shaft 512 by a fastener 524.

Referring to FIG. 18, one of the bushings 544 may be operably associated with an operating system 503 that is rotatably supported by one of the end caps 26. The operating system 503 may be configured to rotate the roller 40 and thus move the shade 22 between extended and retracted positions. The operating system 503 may receive an input force from a user pulling downwardly on an operating element 505 and convert the input force into a rotational output force that rotationally drives the accumulator roller 40 to wrap or unwrap the shade 22 about or from the roller 40. To retract the shade 22 from an extended position (see FIG. 1A), the operator may pull the operating element 505 in a downwardly direction to rotate the roller 40 in a retraction direction and wrap the shade 22 around the roller 40. To extend the shade 22, the operator may pull the operating element 505 in a lateral direction to rotate the roller 40 in an extension direction and unwrap the shade 22 from the roller 40. The operating system 503 may include a brake element to hold or maintain the shade 22 in a desired position. As previously discussed, other operating systems may be used to extend and/or retract the shade 22, such as an electric motor and/or a spring assist module or counterbalancing unit.

Referring to FIGS. 18-20, the bushing 544 opposite the operating system 503 may be rotatably mounted onto a limit screw 519, which may form part of a limit assembly 516 configured to set a travel limit or stop for the shade 22. The limit assembly 516 may be positioned within the roller 40 by inserting the limit assembly 516 through an opening defined by an end of the roller 40. The limit assembly 516 and the roller 40 may be substantially aligned along the longitudinal axis 118 of the roller 40. The limit assembly 116 may include an externally-threaded, non-rotatable shaft or limit screw 519, a bottom stop 520 attached to the limit screw 519, and a travelable nut 522 threaded onto the limit screw 519. The limit screw 519 may be non-rotatably attached to the end cap 26 via a keyed engagement with the end cap 26. A fastener 524 may axially secure the limit screw 518 to the end cap 26.

The travelable nut 522 may be threaded onto the limit screw 519 and may be non-rotatably keyed to the roller 40. The nut 522 may rotate substantially in unison with the roller 40, which may cause the nut 522 to translate or travel along a length of the limit screw 519 during rotation of the roller 40. When the roller 40 is rotated in a shade raising or retracting direction, the nut 522 may translate axially along the limit screw 519 away from bottom stop 520. Conversely, when the roller 40 is rotated in a shade dispensing or extending direction, the nut 522 may translate axially along the limit screw 519 toward the bottom stop 520. Upon the shade 22 reaching a fully-extended position, the nut 522 may contact or engage the bottom stop 520, thereby substantially preventing further rotation of the roller 40.

The shade actuator system 502 may be operative to open or expand the shade 22 at substantially any extended position. Referring to FIGS. 18-20, the shade actuator system 502 may include a cam mechanism 553 that operably connects the accumulator roller 40 and the shade actuation roller 504. The cam mechanism 553 may be configured to selectively lock the rotation of the shade actuation roller 504, causing the shade 22 to open or expand, based on the rotation of the accumulator roller 40.

Referring to FIGS. 18-25, the cam mechanism 553 may include an engaged or locking position and a disengaged position. When in the engaged position, the cam mechanism 553 may lock or prevent rotation of the shade actuation roller 504. The rotationally-locked or non-rotatable roller 504 may cause relative movement between the front and rear sheets 30, 34 of the shade 22, resulting in the expansion or opening of the shade 22 during which the vanes 38 may tilt from a substantially vertical orientation below the roller 504 to a substantially horizontal orientation. When in the disengaged position, the cam mechanism 553 may permit rotation of the shade actuation roller 504. The rotationally-free or rotatable roller 504 may permit movement of the shade 22 over the roller 504 without interfering with the relative positioning of the sheets 30, 34, thereby permitting extension and retraction of the shade 22 in a closed configuration.

The cam mechanism 553 may be actuated into the engaged position at any extended position of the shade 22, providing the operator the ability to open the shade 22 (see FIG. 2) at any shade position between fully retracted and fully opened positions. In some examples, the cam mechanism 553 is actuated by reversing the direction of the shade 22. For instance, the cam mechanism 553 may be moved into the engaged position by moving the shade 22 in a first direction and subsequently moving the shade 22 in a second, opposite direction. In some examples, the cam mechanism 553 causes the shade 22 to expand or open within ½ to 1 revolution of the accumulator roller 40 in the second, opposite direction.

Referring to FIGS. 19-25, the cam mechanism 553 may include a rotational cam plate 554, a pivotable cam follower or lever 556, and an engagement member 558. The cam plate 554 may selectively rotate with the accumulator roller 40 within an angular range operative to expand or open the vanes 38. During rotation of the cam plate 554, the lever 556 may be pivotally biased into engagement with the cam plate 554, and the lever 556 may selectively engage the engagement member 558 based on the rotational position of the cam plate 554. When the lever 556 is engaged with the engagement member 558, the lever 556 may prevent rotation of the shade actuation roller 504, causing the shade 22 to open or expand beneath the roller 504. When the lever 556 is not engaged with the engagement member 558, the lever 556 may permit rotation of the shade actuation roller 504, allowing extension and retraction of the shade 22 in a closed configuration.

Referring to FIGS. 20-25, the cam plate 554 may be located adjacent one end of the accumulator roller 40 and may be rotatable about the longitudinal axis 41 of the roller 40. The cam plate 554 may be mounted onto one of the bushings 544, which may be keyed to the accumulator roller 40 and rotatably mounted onto the limit screw 519 (see FIGS. 19 and 20). The cam plate 554 may be formed as an annular or ring-shaped structure. The cam plate 554 may include a cylindrical or substantially cylindrical inner surface 560, which may be sized to fit around a portion of the bushing 544.

Figure 24:
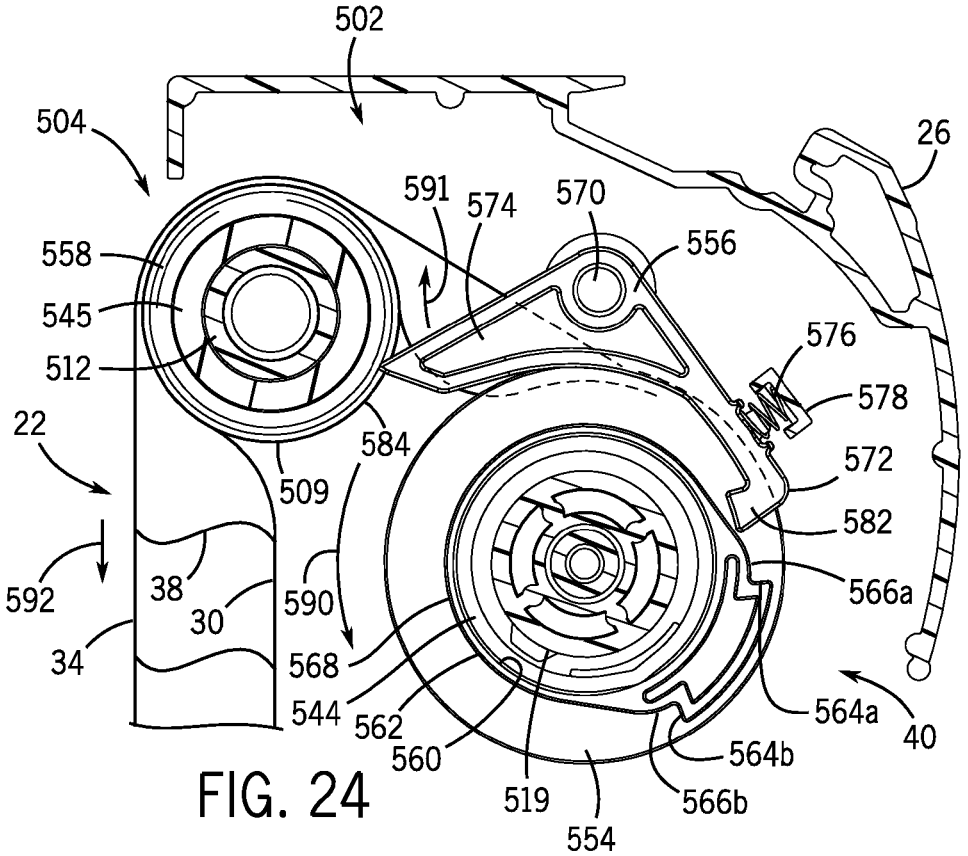
FIG. 24 is a transverse section view of the covering of FIG. 1A taken along the line 21-21 illustrated in FIG. 18 with the shade actuator system of FIG. 18.
Figure 25:
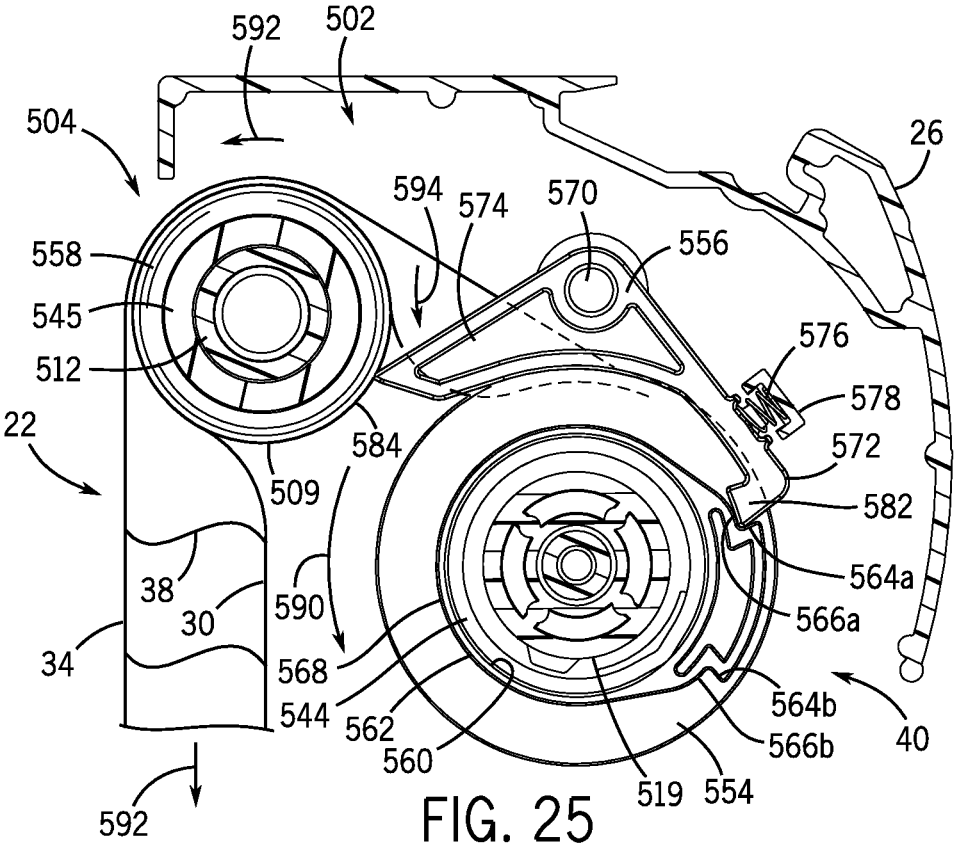
FIG. 25 is a transverse section view of the covering of FIG. 1A taken along the line 21-21 illustrated in FIG. 18 with the shade actuator system of FIG. 18.
Figure 26:
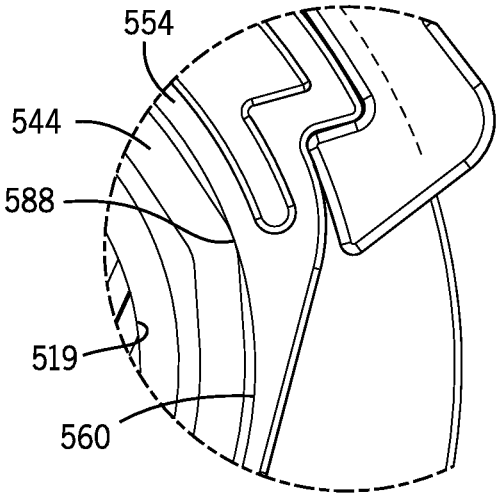
FIG. 26 is an enlarged view of the shade actuator system of FIG. 18 taken along the line 26-26 illustrated in FIG. 21.

Referring to FIGS. 21-26, the cam plate 554 may be frictionally mounted onto the bushing 544 so that the cam plate 554 rotates in unison with the bushing 544, and thus the roller 40, until a force is applied to the cam plate 554 in a direction opposing the rotation and in a magnitude that overcomes the friction between the cam plate 554 and the bushing 544. Referring to FIG. 26, a drag knuckle 588 may protrude radially outwardly from a portion of the bushing 544 and may engage the inner surface 560 of the cam plate 554. The interface between the drag knuckle 588 and the bushing 544 may generate a frictional force that ensures the cam plate 554 rotates in unison with the bushing 544 about the longitudinal axis 41 of the roller 40 until acted upon by the lever 556.

Referring to FIGS. 21-25, the cam plate 554 may include a first cam surface 562 positioned radially outwardly of the inner surface 560. The first cam surface 562 may extend in a curved path around a majority of the inner surface 560 and may terminate at abutment shoulders or stops 564, which may extend outwardly from the first cam surface 562 at a transverse angle, such as an acute angle. The cam plate 554 may include a second cam surface 565 extending between the stops 564 opposite the first cam surface 562 such that the first cam surface 562, the stops 564, and the second cam surface 565 form a closed loop. The first cam surface 562 may transition into inner ends of the stops 564, and outer ends of the stops 564 may transition into the second cam surface 565. In some examples, as measured about a central axis 41 of the accumulator roller 40, the first cam surface 562 extends around about 160 degrees of the inner surface 560, the stops 564 are spaced about 20 degrees apart from one another, and the second cam surface 565 extends around about 20 degrees of the inner surface 560 in opposing relationship the first cam surface 562.

With continued reference to FIGS. 21-25, the first cam surface 562 may define parking positions 566 adjacent the stops 564 and an intermediate portion 568 extending between and connecting the parking positions 566. The parking positions 566 may be disposed at a different radial distance from the central axis 41 of the accumulator roller 40 than the intermediate portion 568. In some examples, the parking positions 566 may be disposed radially outwardly of the intermediate portion 568.

Referring to FIGS. 19-25, the lever 556 may be pivotally attached to a post 570 on the end cap 26. The lever 556 may be pivotable about the post 570 relative to the engagement member 558. The lever 556 may include a first or cam follower leg 572 and a second or locking leg 574. The cam follower and locking legs 572, 574 may extend away from the post 570 at an angle relative to one another. In some examples, the cam follower and locking legs 572, 574 may extend at near right angles to one another. It is contemplated that this relative positioning may be adjusted as needed given the geometry of the particular usage.

With continued reference to FIGS. 19-25, the cam follower leg 572 may extend away from the post 570 toward the cam plate 554. The cam follower leg 572 may contact and generally ride along the first cam surface 562, the second cam surface 565, or both. The cam follower leg 572 may be biased into contact with the first and/or second cam surfaces 562, 565 by a spring element 576, which may be seated against an abutment wall 578 protruding axially from the end cap 26. The spring element 576 may be positively located along the cam follower leg 572 by a fixed mandrel 580 that protrudes from an outer surface of the cam follower leg 572. The end of the cam follower leg 572 may include an inturned foot 582 that confronts and rides along the first cam surface 562.

With continued reference to FIGS. 19-25, the locking leg 574 may extend away from the post 570 towards the engagement member 558. The locking leg 574 may be selectively engageable with the engagement member 558 based on the position of the cam follower leg 572 along the first and/or second cam surfaces 562, 565. The locking leg 574 may move in unison with the cam follower leg 572 and thus may pivot about the post 570 as the foot 582 of the cam follower leg 572 moves along the first cam surface 562.

Referring still to FIGS. 19-25, the engagement member 558 may be non-rotatably secured to one of the bushings 545 and may be disposed alongside the cam plate 554. The locking leg 574 of the lever 556 may engage the engagement member 558 to restrict rotation of the shade actuation roller 504. Referring to FIGS. 21-25, the engagement member 558 may be non-rotatably mounted onto the bushing 545 so that the engagement member 558, the bushing 545, and the shade actuation roller 504 rotate in unison with one another about the longitudinal axis 518 of the roller 504 (see FIG. 18). In some examples, the engagement member 558 may be formed as a circular frictional element that is frictionally secured to the bushing 545. In some examples, the engagement member 558 is a rubber O-ring. In some examples, the engagement member 558 is a polymer material overmolded onto the bushing 545. In some examples, the engagement member 558 is a cog wheel similar to the gear 110 and is positively engaged by the locking leg 574 of the lever 556.

With reference to FIGS. 18-25, the longitudinal axis 518 of the shade actuation roller 504 may be positioned rearwardly and upwardly of the longitudinal axis 41 of the roller 40, and the pivot axis of the lever 556 (defined by the post 570) may be positioned forwardly of the longitudinal axis 518 of the shade actuation roller 504 and upwardly of the longitudinal axis 41 of the roller 40. The longitudinal axes of the roller 40, the shade actuation roller 504, and the lever 556 may be substantially parallel to one another.

With reference to FIGS. 18-25, the shade 22 may be unwrapped from a top portion of the accumulator roller 40 in a rearwardly direction, draped over the shade actuation roller 504, and extended downwardly from a rear side of the shade actuation roller 504. The shade actuation roller 504 may be positioned rearwardly of the roller 40 and underneath the shade 22 such that the shade actuation roller 504 may abut or contact the front sheet 30 of the shade 22. The cam plate 554, the lever 556, and the engagement member 558 may be positioned laterally outwardly of the side edges of the shade 22 so as to not interfere with the movement of the shade 22. That is, the shade 22 may be wrapped around the accumulator roller 40 and draped over the shade actuation roller 504 alongside the cam plate 554, the lever 556, and the engagement member 558. In an alternative implementation, the arrangement of the roller 40, the shade actuation roller 504, and the cam mechanism 553 may be flipped from rear to front so that the shade 22 is unwrapped from a top portion of the roller 40 in a forwardly direction and the rear sheet 34 of the shade 22 contacts the roller 504.

Figure 21:
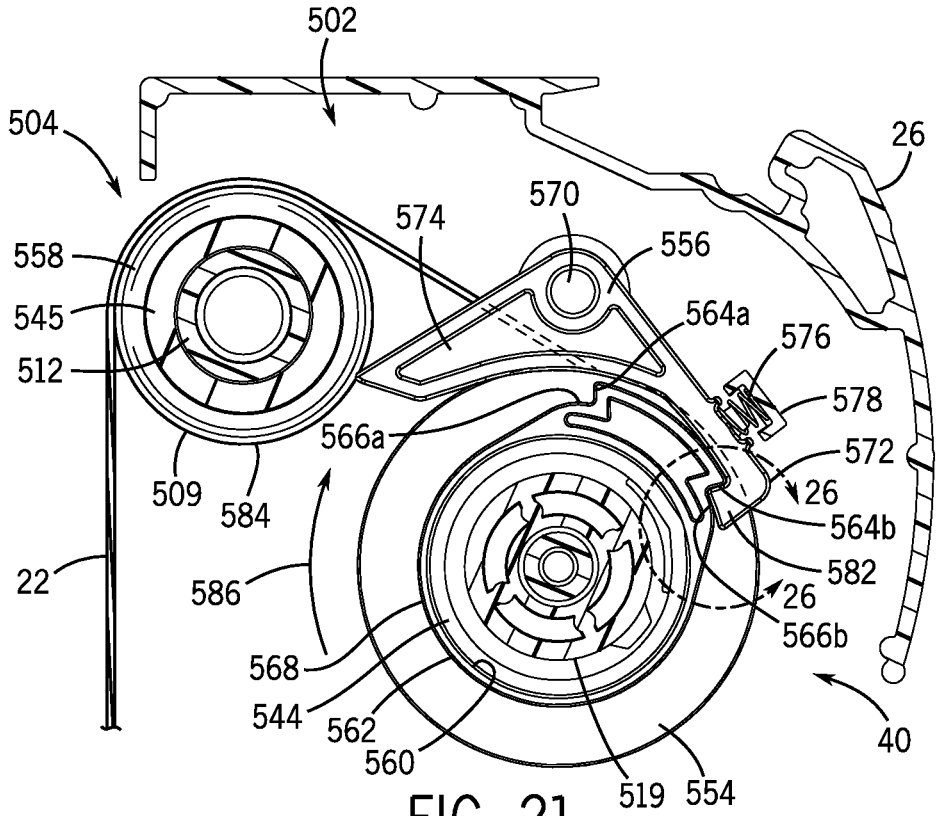
FIG. 21 is a transverse section view of the covering of FIG. 1A taken along the line 21-21 illustrated in FIG. 18 with the shade actuator system of FIG. 18.
Figure 22:
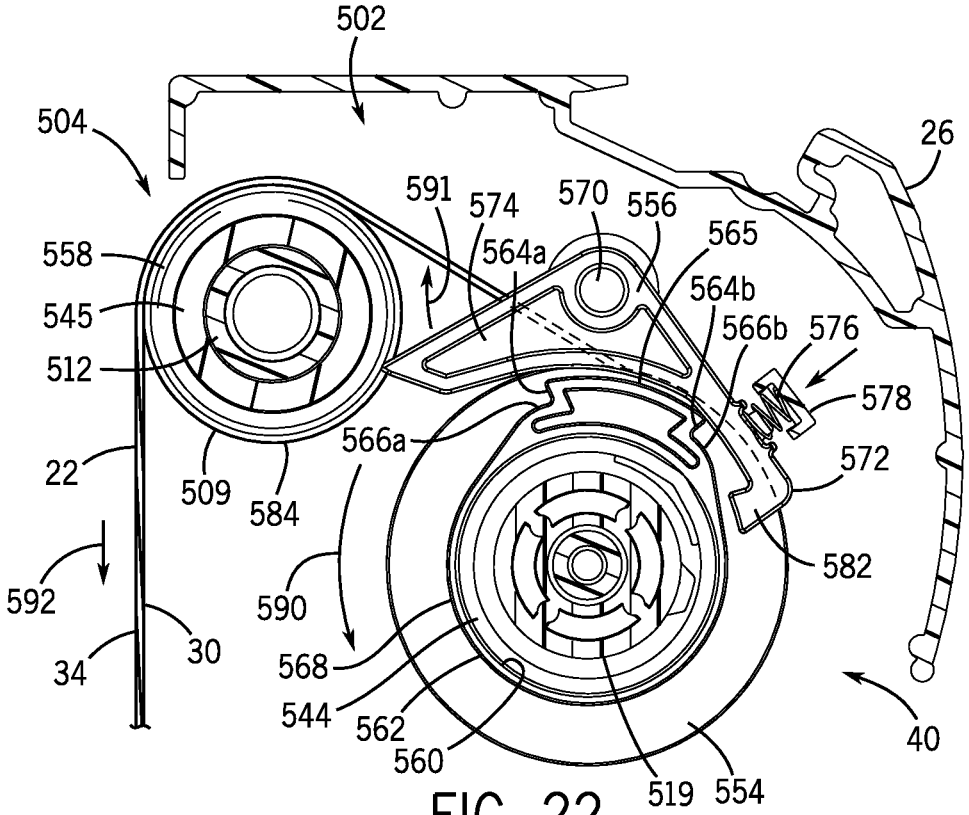
FIG. 22 is a transverse section view of the covering of FIG. 1A taken along the line 21-21 illustrated in FIG. 18 with the shade actuator system of FIG. 18.
Figure 23:
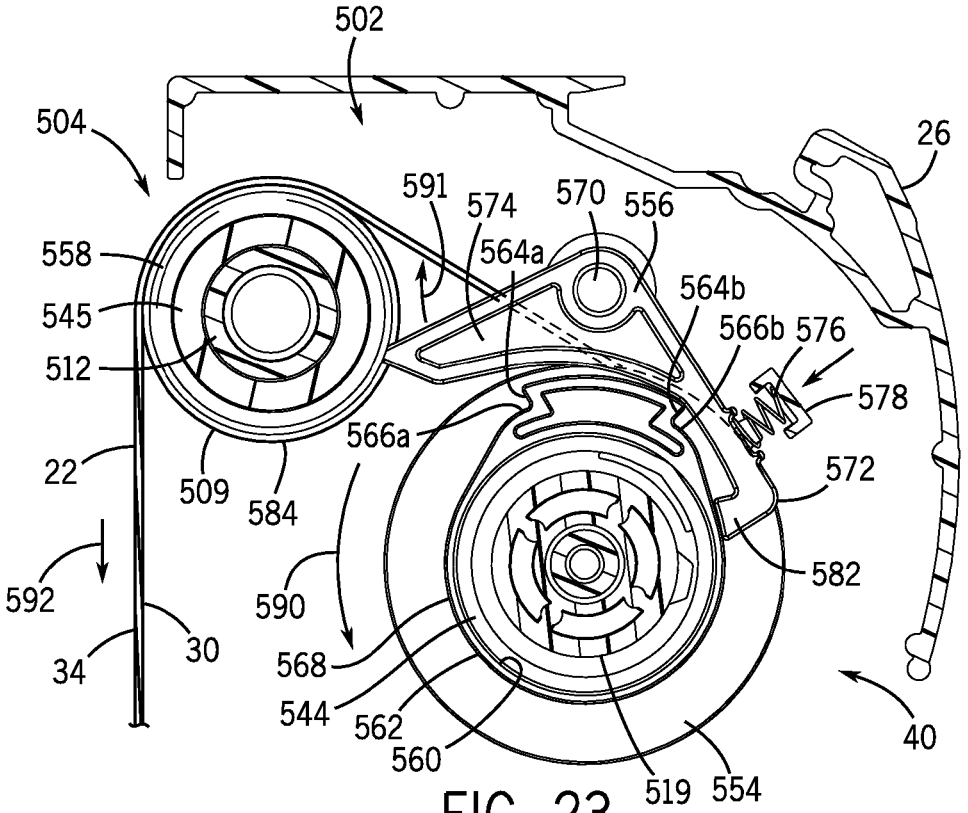
FIG. 23 is a transverse section view of the covering of FIG. 1A taken along the line 21-21 illustrated in FIG. 18 with the shade actuator system of FIG. 18.

Referring to FIGS. 18 and 21-25, an outer surface 508*a* of the shade actuation roller 504 may be formed as a grip surface 509 so that movement of the shade 22 over the shade actuation roller 504 when the roller 504 is in a rotatable state rotates the shade actuation roller 504, and movement of the shade 22 over the roller 504 when the roller 504 is in a non-rotatable state restricts motion of the front sheet 30 of the shade 22, resulting in relative movement between the sheets 30, 34 and opening or expansion of the shade 22 beneath the roller 504 (see FIGS. 23 and 24). In some implementations, the shade actuator roller 504 may be wrapped with a short nap fabric strip 584 (see FIGS. 21-25), which may define the grip surface 509 and may couple the motion of the front sheet 30 and the actuation roller 504. The short nap fabric 584 may engage or extend into openings or recesses defined by the confronting front sheet 30, such as weave recesses. The short nap fabric 584 may be time and temperature stable such that the short nap fabric does not change characteristic with time or temperature. The short nap fabric 584 may be configured to not mar or wear off onto the sheets 30, 34.

With reference to FIG. 21, the shade actuator system 502 is illustrated in a raising or raised position with the shade 22 in a closed configuration. In this raising or raised position, the lever 556 is disengaged from the engagement member 558, resulting in free rotation of the shade actuation roller 504. As shown in FIG. 21, the tip of the locking leg 574 may be positioned alongside the grip surface 509 and radially outwardly of the engagement member 558.

With continued reference to FIG. 21, the foot 582 of the cam follower leg 572 may be seated in the top parking position 566*b* of the cam surface 562, resulting in the locking leg 574 being pivoted out of engagement with the engagement member 558. During retraction of the shade 22 (retraction direction indicated by arrow 586 in FIG. 21), the foot 582 engages the stop 564 to prevent the cam plate 554 from rotating with the accumulator roller 40. The engagement of the foot 582 against the stop 564 overcomes the frictional engagement of the cam plate 554 and the bushing 545, allowing the accumulator roller 40 to continue to rotate and retract the shade 22 after the foot 582 contacts the stop 564 while preventing rotation of the cam plate 554. As such, after the foot 582 engages the stop 564, the foot 582 remains in the top parking position 566*b* during retraction of the shade 22, thereby maintaining the lever 556 in a disengaged position during retraction of the shade 22.

After the shade 22 is retracted to a desired position, the operator may rotate the accumulator roller 40 less than one revolution in an extension direction (indicated by arrow 590 in FIG. 22) to expand or open the shade 22. During extension of the shade 22, the cam plate 564 may rotate in unison with the accumulator roller 40 due to the frictional engagement between the cam plate 554 and the bushing 545, and may rotate relative to the lever 556 such that the top stop 564*b* moves away from the foot 582. During rotation of the cam plate 554 relative to the lever 556, the spring element 576 may bias the cam follower leg 572 inwardly into contact with at least one of the cam surfaces 562, 565.

Referring to FIGS. 21-22, from the top parking position 566*b* of FIG. 21, an inner surface of the cam follower leg 572 initially may ride along the second cam surface 565 to prevent the locking leg 574 from prematurely engaging the engagement element 558, allowing the shade 22 to extend over the shade actuation roller 504 without actuation of the vanes 38. The second cam surface 565 may permit the shade 22 and bottom rail 18 to extend from a fully retracted position a sufficient distance beneath the head rail 14 before the cam mechanism 553 moves into the engaged position and expands or opens the shade 22. The configuration of the first and second cam surfaces 562, 562 also may enable use of the cam plate 554 on left or right hand coverings.

Referring to FIG. 23, after an initial rotation of the cam plate 554 in the extension direction 590, the cam follower leg 572 may be biased radially inwardly by the spring 576 so that the foot 582 rides along the first cam surface 562, resulting in the locking leg 574 pivoting radially outwardly about the post 570 into engagement with the engagement member 558 (see arrow 591 in FIGS. 22 and 23). Once engaged with the engagement member 558, the locking leg 574 of the lever 556 prevents the engagement member 558, and thus the shade actuation roller 504, from rotating about its longitudinal axis 518. As the operator continues to extend the shade 22 in the extension direction (see arrow 592 in FIG. 23), the foot 582 of the lever 556 rides along the intermediate portion 568 of the first cam surface 562, which may be defined at a constant radius about the longitudinal axis 41 of the accumulator roller 40.

During movement of the foot 582 along the intermediate portion 568 of the first cam surface 562, the locking leg 574 remains in locking engagement with the engagement member 558 to prevent rotation of the shade actuation roller 504. Referring to FIGS. 23 and 24, during continued extension of the shade 22 in the extension direction 592, the grip surface 509 of the rotationally-locked shade actuator system 502 may prevent the front sheet 30 from moving over the shade actuation roller 504. As such, an extra length of the rear sheet 34 may be extended downwardly from the shade actuation roller 504 relative to the front sheet 30, which may result in the bottom rail 18 and/or vanes 38 separating the front and rear sheets 30, 34 as illustrated in FIG. 24. The bottom rail 18 and/or the vanes 38 may bias the front and rear sheets 30, 34 away from each other and may cause a portion of the front sheet 30 to wrap around a bottom portion of the shade actuation roller 504 (see FIG. 24). As shown in FIG. 24, a portion of the front sheet 30 may collect in a downwardly bulge or droop between the accumulating roller 40 and the shade actuation roller 504. The full opening or expansion of the shade 22 may occur between about ½ to about 1 revolution of the cam plate 554 in the extension direction 590 from the top parking position 566*b*.

Referring to FIGS. 24 and 25, as the accumulator roller 40 continues to rotate in the shade extension direction 590, the cam plate 554 continues to rotate in unison with the roller 40 and the foot 582 of the lever 556 continues to ride along the intermediate portion 568 of the first cam surface 562. As the foot 582 approaches the bottom parking position 566*a*, the foot 582 rides upwardly along the first cam surface 562, resulting in the cam follower leg 572 pivoting radially outwardly against the bias of the spring element 576 and the locking leg 574 pivoting radially inwardly (see arrow 594 in FIG. 25) out of engagement with the engagement member 558. Disengagement of the locking leg 574 from the engagement member 558 releases the shade actuation roller 504 and permits free rotation of the roller 504.

Upon release of the shade actuation roller 504, the weight of the bottom rail 18 (see FIGS. 1A and 2) and of the suspended portion of the front sheet 30 may remove the slack of the front sheet 30 disposed between the rollers 40, 504, thereby closing the vanes 38. Continued rotation of the accumulator roller 40 in the extension direction 590 results in lowering of the shade 22 in the closed configuration. The engagement of the foot 582 against the bottom stop 564*a* may overcome the frictional engagement between the cam plate 554 and the bushing 544 and prevent the cam plate 554 from rotating with the accumulator roller 40.

With continued reference to FIG. 25, to retract the shade 22 from an extended position, the operator may actuate the operating system 503 (see FIG. 18) to rotate the accumulator roller 40 about its longitudinal axis 41 in the retraction direction 586 (see FIG. 21). Upon rotation of the accumulator roller 40 in the retraction direction 586, the shade 22 is pulled upwardly over the shade actuation roller 504 and wrapped around the roller 40. The upwardly motion of the shade 22 causes the roller 504 to rotate in a retraction direction (clockwise in FIG. 21) about its longitudinal axis 518.

Referring to FIGS. 21-25 in reverse order, rotation of the accumulator roller 40 in the retraction direction 586 (see FIG. 21) between about ½ and about 1 revolution from an extended, closed position (see FIG. 25) resets the cam mechanism 563 into the disengaged position of FIG. 21. During retraction, the cam plate 554 initially rotates in unison with the roller 40 due to the frictional engagement of the cam plate 554 and the bushing 544. Upon the top stop 564*b* of the cam plate 554 rotating into engagement with the foot 582 of the lever 556, the lever 556 overcomes the frictional engagement between the cam plate 564 and the roller 40 and prevents the cam plate 564 from rotating with the roller 40 in the retraction direction 586 (see FIG. 21). Once the foot 582 reaches the top parking position 566*b* (see FIG. 21), the cam mechanism 563 is reset into its operative position where the cam mechanism 563 expands or opens the shade 22 within ½ to 1 revolution of the accumulator roller 40 in the extension direction 590 (see FIGS. 22-25).

During retraction of the shade 22, the shade actuation system 502 may be configured to permit free rotation of the shade actuation roller 504 regardless of the pivotal position of the lever 556. When the lever 556 is disengaged with the engagement member 558 (e.g., when the foot 582 is seated in the bottom or top parking positions 566*a*, 566*b* of the first cam surface 562), the lever 556 does not obstruct the rotational motion of the engagement member 558 and thus of the shade actuation roller 504. When the lever 556 is engaged with the engagement member 558 (e.g., when the foot 582 is riding along the intermediate portion 568 of the first cam surface 562), the locking leg 574 of the lever 556 may allow the engagement member 558 to slip past the locking leg 574 without restricting the rotation of the shade actuation roller 504. As shown in FIGS. 21-25, the tip of the locking leg 574 may be directed or pointed generally in the retraction direction of the engagement member 558 (clockwise in FIGS. 21-25) in a substantially acute or tangential relationship to an outer periphery of the engagement member 558, and thus the locking leg 574 does not obstruct the rotation of the engagement member 558 or shade actuation roller 504 during retraction of the shade 22.

Generally, raising the shade 22 less than one revolution of the roller 40 resets the cam mechanism 563. Once the cam mechanism 563 is reset, raising the shade 22 further causes the resistive element 588 (see FIG. 26) to slip relative to the bearing 544. The resistive element 588 may maintain the cam plate 564 in a suitable position to lock the shade actuation roller 504 upon lowering of the shade 22. When the shade 22 is extended downwardly, the cam plate 564 pivots the lever 556 into engagement with the shade actuation roller 504 to lock the rotation of the shade actuation roller 504. Continuing to lower the shade 22 causes the cam plate 564 to rotate with the accumulator roller 40 and expand or open the shade 22. The cam plate 564 continues to rotate with the accumulator roller 40 until the cam plate 564 pivots the lever 556 out of engagement with the shade actuation roller 504, which allows the roller 504 to rotate freely. Once the shade actuation roller 504 is freely rotatable, the bottom rail 18 and/or the front sheet 30 may rotate the roller 504 and close the shade 22 for further extension.

The foregoing description has broad application. While the provided examples generally describe one type of shade, it should be appreciated that the concepts disclosed herein may equally apply to any type of shade movable between closed or collapsed positions and open or expanded positions. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation.

The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A covering for an architectural opening, comprising:

an accumulator roller;

a shade attached to and wrappable about the accumulator roller, the shade including two laterally-separable sheets interconnected by a plurality of vertically-spaced vanes; and a shade actuator system that engages a confronting face of one sheet of the two laterally-separable sheets to restrict movement of the one sheet relative to the other sheet of the two laterally-separable sheets, wherein the shade actuator system comprises:

an actuation roller with a grip surface; and a device that selectively locks rotation of the actuation roller during rotation of the accumulator roller to cause relative movement between the two laterally-separable sheets.

2. The covering of claim 1, wherein the shade drapes over the actuation roller.

3. The covering of claim 1, wherein the device includes a cam mechanism that operably connects the accumulator roller and the actuation roller to selectively lock rotation of the actuation roller and open the shade based on rotation of the accumulator roller.

4. The covering of claim 3, wherein the cam mechanism is actuated by reversing a direction of the shade.

5. The covering of claim 1, wherein the device includes a cam plate that selectively rotates with the accumulator roller within an angular range operative to open the shade.

6. The covering of claim 5, wherein the device includes a cam follower that contacts a cam surface of the cam plate.

7. The covering of claim 6, wherein:

the device includes an engagement member non-rotatably coupled to the actuation roller; and the cam follower includes a first leg and a second leg that is selectively engageable with the engagement member based on a position of the first leg along the cam surface.

8. The covering of claim 7, wherein:

the cam follower is pivotable about an axis defined between the first and second legs.

9. The covering of claim 1, wherein the grip surface extends around an entire periphery of the actuation roller.

10. The covering of claim 1, wherein the grip surface extends partially around a periphery of the actuation roller.

11. The covering of claim 1, wherein the grip surface is associated with a fin that projects outwardly from an outer surface of the actuation roller.

12. The covering of claim 1, wherein the device includes a locking bar.

13. The covering of claim 12, wherein:

the actuation roller includes an external gear; and the locking bar includes a lever with a gear profile corresponding to the external gear.

14. The covering of claim 13, wherein the shade extends between the actuation roller and the locking bar.

15. The covering of claim 1, wherein the shade actuator system is engageable with the one sheet at a partially extended position of the shade.

16. A covering for an architectural opening, comprising:

an accumulator roller;

a shade attached to and wrappable about the accumulator roller, the shade including two laterally-separable sheets interconnected by a plurality of vertically-spaced vanes; and a shade actuator system that engages a confronting face of one sheet of the two laterally-separable sheets to restrict movement of the one sheet relative to the other sheet of the two laterally-separable sheets, wherein the shade actuator system includes:

a grip surface that selectively engages and restricts movement of the one sheet to cause relative movement between the two laterally-separable sheets; and a slider mechanism operably coupled with the grip surface so that the grip surface is movable between a first position in which the grip surface is held away from the one sheet and a second position in which the grip surface is held in engagement with the one sheet.

17. The covering of claim 16, wherein the slider mechanism includes a slider plate that is constrained to axial movement towards and away from the one sheet and to which the grip surface is attached.

18. The covering of claim 17, wherein:

the slider mechanism further includes a positioning device that defines a pathway; and the slider plate includes a pin that extends into the pathway.

19. The covering of claim 18, wherein the pathway forms a closed loop.

20. The covering of claim 19, wherein the pathway defines an island.

21. The covering of claim 18, wherein the pathway is recessed into a face of the positioning device that confronts the slider plate.

22. A covering for an architectural opening, comprising:

an accumulator roller;

a shade attached to and wrappable about the accumulator roller, the shade including two laterally-separable sheets interconnected by a plurality of vertically-spaced vanes; and a shade actuator system that engages a confronting face of one sheet of the two laterally-separable sheets to restrict movement of the one sheet relative to the other sheet of the two laterally-separable sheets, wherein:

the shade actuator system includes a grip surface that is movable into and out of engagement with the one sheet; and the grip surface is fixed against rotation when the grip surface is engaging the one sheet so that continued rotation of the accumulator roller while the one sheet is gripped by the grip surface causes the other sheet to move relative to the one sheet.

* * * * *